US008247149B2

(12) United States Patent
Yagi et al.

(10) Patent No.: US 8,247,149 B2
(45) Date of Patent: Aug. 21, 2012

(54) ELECTROPHOTOGRAPHIC DEVELOPER CARRIER, ELECTROPHOTOGRAPHIC DEVELOPER, IMAGE FORMING METHOD, PROCESS CARTRIDGE AND IMAGE FORMING APPARATUS

(75) Inventors: Shinichiro Yagi, Numazu (JP); Kousuke Suzuki, Numazu (JP); Masashi Nagayama, Machida (JP)

(73) Assignee: Ricoh Company, Ltd., Tokyo (JP)

( * ) Notice: Subject to any disclaimer, the term of this patent is extended or adjusted under 35 U.S.C. 154(b) by 599 days.

(21) Appl. No.: 12/326,720

(22) Filed: Dec. 2, 2008

(65) Prior Publication Data

US 2009/0142678 A1 Jun. 4, 2009

(30) Foreign Application Priority Data

Dec. 3, 2007 (JP) ..... 2007-312330

(51) Int. Cl.
*G03G 9/00* (2006.01)

(52) U.S. Cl. ..... 430/111.35; 430/110.2; 430/110.4; 430/111.4

(58) Field of Classification Search ..... 430/110.2, 430/110.4, 111.35, 111.41
See application file for complete search history.

(56) References Cited

U.S. PATENT DOCUMENTS 6,040,102 A * 3/2000 Takahashi et al. ..... 430/108.6
7,132,210 B2 11/2006 Suzuki et al.
7,252,919 B2 8/2007 Suzuki et al.
7,309,558 B1 12/2007 Michel et al.
7,344,812 B2 3/2008 Suzuki et al.
7,381,513 B2 6/2008 Suzuki et al.
7,396,630 B2 7/2008 Watanabe et al.
2005/0079434 A1 4/2005 Suzuki et al.
2005/0277040 A1 12/2005 Michel et al.
2006/0020069 A1 1/2006 Michel et al.
2006/0057487 A1 3/2006 Nagayama et al.
2006/0073405 A1 * 4/2006 Matsuda et al. ..... 430/111.1
2006/0210906 A1 9/2006 Suzuki et al.
2006/0251982 A1 11/2006 Iwatsuki et al.
2006/0291911 A1 12/2006 Yamashita et al.
2007/0015078 A1 1/2007 Suzuki et al.
2007/0048652 A1 3/2007 Imahashi et al.
2007/0202430 A1 8/2007 Suzuki et al.
2008/0076054 A1 * 3/2008 Nozaki et al. ..... 430/110.2
2008/0096121 A1 4/2008 Iwatsuki et al.
2008/0152393 A1 6/2008 Nagayama et al.

(Continued)

FOREIGN PATENT DOCUMENTS

JP 54-155048 12/1979

(Continued)

*Primary Examiner* — Thorl Chea
(74) *Attorney, Agent, or Firm* — Oblon, Spivak, McClelland, Maier & Neustadt, L.L.P.

(57) ABSTRACT

To provide an electrophotographic developer carrier including a carrier core material, and a coat layer containing a binder resin and conductivity-imparted microparticles which are produced by imparting conductivity to inorganic microparticles, the coat layer being formed over the carrier core material, wherein the electrophotographic developer carrier has a static resistivity of 10 [Log (Ω·cm)] or higher and a dynamic resistivity of 9 [Log (Ω)] or lower, and is used in an electrophotographic developer together with a negatively chargeable toner having an average circularity of 0.925 to 0.970, and wherein the toner includes a resin, a colorant and an inorganic layered mineral in which at least part of interlayer ions is modified with organic ions, and is granulated by dispersing and/or emulsifying an oil phase and/or a monomer phase containing at least a toner composition and/or a toner composition precursor in an aqueous medium.

12 Claims, 4 Drawing Sheets

U.S. PATENT DOCUMENTS

| | | | | |
|---|---|---|---|---|
| 2008/0213684 | A1 | 9/2008 | Nagayama et al. | |
| 2009/0142678 | A1* | 6/2009 | Yagi et al. | 430/48 |

FOREIGN PATENT DOCUMENTS

| | | |
|---|---|---|
| JP | 57-40267 | 3/1982 |
| JP | 58-108548 | 6/1983 |
| JP | 58-108549 | 6/1983 |
| JP | 59-166968 | 9/1984 |
| JP | 62-266550 | 11/1987 |
| JP | 1-19584 | 4/1989 |
| JP | 3-628 | 1/1991 |
| JP | 5-66600 | 3/1993 |
| JP | 5-273789 | 10/1993 |
| JP | 6-202381 | 7/1994 |
| JP | 7-140723 | 6/1995 |
| JP | 8-6307 | 1/1996 |
| JP | 8-179570 | 7/1996 |
| JP | 8-211655 | 8/1996 |
| JP | 8-286429 | 11/1996 |
| JP | 9-160304 | 6/1997 |
| JP | 2683624 | 8/1997 |
| JP | 10-20552 | 1/1998 |
| JP | 11-7156 | 1/1999 |
| JP | 2959927 | 7/1999 |
| JP | 2959928 | 7/1999 |
| JP | 11-352727 | 12/1999 |
| JP | 2000-122337 | 4/2000 |
| JP | 3120460 | 10/2000 |
| JP | 3129074 | 11/2000 |
| JP | 2002-229325 | 8/2002 |
| JP | 2003-515795 | 5/2003 |
| JP | 2003-167389 | 6/2003 |
| JP | 2003-202708 | 7/2003 |
| JP | 2003-270954 | 9/2003 |
| JP | 2003-345070 | 12/2003 |
| JP | 2005-49858 | 2/2005 |
| JP | 2006-500605 | 1/2006 |
| JP | 2006-503313 | 1/2006 |
| JP | 3879838 | 11/2006 |
| JP | 2007-156400 | 6/2007 |
| JP | 2007-248614 | 9/2007 |
| JP | 2007-272205 | 10/2007 |
| JP | 2007-279685 | 10/2007 |

* cited by examiner

ELECTROPHOTOGRAPHIC DEVELOPER CARRIER, ELECTROPHOTOGRAPHIC DEVELOPER, IMAGE FORMING METHOD, PROCESS CARTRIDGE AND IMAGE FORMING APPARATUS

BACKGROUND OF THE INVENTION

1. Field of the Invention

The present invention relates to a color carrier and a developer used for developing an electrostatic image in, for example, electrophotography, electrostatic recording and electrostatic printing; to an image forming method, a process cartridge and an image forming apparatus which use the developer.

2. Description of the Related Art

In one process through electrophotography, an electrostatic latent image is formed on an image bearing member through charging and light exposing, and then is developed with a developer containing toner to form a toner image. The thus-formed toner image is transferred onto and fixed on a recording medium. Also, toner particles which have been not transferred onto a recording medium; i.e., toner particles remaining on the image bearing member are cleaned with a cleaning member such as a blade provided so as to be in contact with the image bearing member surface.

Meanwhile, toner is produced with, for example, the pulverization method. In the pulverization method, a colorant and an optionally used additive are added to a thermoplastic resin serving as a binder resin, and the resultant mixture is melt-kneaded, pulverized and classified. The toner produced with this method, however, has a large particle diameter, making it difficult to form high-quality images.

In view of this, the polymerization method and the emulsion dispersion method are employed for toner production.

In one known process based on the polymerization method, a monomer, a polymerization initiator, a colorant, a charge controlling agent, etc. are added under stirring to an aqueous medium containing a dispersant to form oil droplets, followed by polymerization (the suspension polymerization method). In another known process, particles are produced through emulsion polymerization or suspension polymerization, and the thus-produced particles are aggregated/fused (the association method).

Such a production method can produce toner with a small particle diameter, but the binder resin of the toner mainly contains a polymerized product obtained through radical polymerization. Thus, there cannot be produced toner whose binder resin mainly contains a polyester resin and/or epoxy resin suitably used for color toner, etc.

In view of this, some patent literatures disclose toner production methods based on the emulsion dispersion method in which a mixture of a binder resin, a colorant, etc., is mixed/emulsified in an aqueous medium (see, for example, Japanese Patent Application Laid-Open (JP-A) Nos. 05-66600 and 08-211655). This production method can produce toner with a small particle diameter and also, use a wide variety of binder resins. But, undesired microparticles are formed, causing emulsification loss.

In view of this, some patent literatures disclose toner production methods in which a polyester resin is emulsified/dispersed and then the formed particles are aggregated/fused (see, for example, JP-A Nos. 10-020552 and 11-007156). This production method can prevent formation of undesired microparticles, reducing emulsification loss.

However, the toner particles produced through the polymerization method or the emulsion dispersion method tend to be spherical attributed to interfacial tension of the oil droplets formed in a dispersion step, which is problematic. This is because the spherical toner particles are difficult to clean with blade cleaning, since they can pass through the gap between the cleaning blade and the photoconductor while rotating.

In view of this, some patent literatures disclose toner production methods in which particles are mechanically treated with stirring at high speed before completion of polymerization, to thereby deform the particles (see, for example, JP-A No. 62-266550).

However, in this production method, the dispersion state becomes unstable and the particles are likely to agglomerate, which is problematic.

In another known production method, particles are aggregated using, as a dispersant, polyvinyl alcohol with a specific saponification degree, to thereby produce associated particles with a particle diameter of 5 μm to 25 μm.

However, the thus-formed associated particles problematically tend to have a large particle diameter.

Also, some patent literatures disclose toner production methods in which a filler is added to an organic solvent together with a toner composition, to thereby form deformed particles (see, for example, JP-A No. 2005-49858).

However, the filler increases the formed toner in viscoelasticity, resulting in elevation of the lower limit of the fixing temperature thereof. Also, when the filler is caused to be present on the toner surface, the viscoelasticity of the toner does not virtually increase. In this case, however, wax is prevented from exuding or binder resin is prevented from melting to outside, leading to degradation of the low-temperature fixing property and hot offset resistance.

Further, some patent literatures disclose charge controlling agents which are an inorganic layered mineral where interlayer ions (e.g., metal cation) are modified with organic ions or other ions; and use of the charge controlling agents in electrophotographic toners (see, for example, JP-A Nos. 2003-515795, 2006-500605, 2006-503313 and 2003-202708).

Meanwhile, regarding a carrier, an appropriate resin material is generally applied onto the carrier surface to form a firm, strong coat layer. This is performed for the purpose of, for example, preventing filming of a toner component on the carrier surface; making the carrier surface uniform; preventing the carrier surface from oxidation; preventing decrease in moisture sensitivity; extending the service life of the developer; preventing the carrier from adhering to the photoconductor surface; preventing the photoconductor from being scratched and/or delaminated by the carrier; controlling the charge polarity; and adjusting the chargeability.

Regarding the coat layer, various production methods are presented; e.g., a specific resin material is used for forming a coat layer (see, for example, JP-A No. 58-108548); various additives are further incorporated into the coat layer (see, for example, JP-A Nos. 54-155048, 57-40267, 58-108549 and 59-166968, Japanese Patent Application Publication (JP-B) Nos. 01-19584 and 03-628, and JP-A Nos. 06-202381 and 2003-345070); an additive is deposited onto the carrier surface (see, for example, JP-A No. 05-273789); conductive particles with a particle diameter greater than the thickness of a coat layer are incorporated thereinto (see, for example, JP-A No. 09-160304); there is used a carrier-coating material mainly containing a benzoguanamine-n-butyl alcohol-formaldehyde copolymer (see, for example, JP-A No. 08-6307); and there is used, as a carrier-coating material, a crosslinked product between a melamine resin and an acrylic resin (see, for example, Japanese Patent (JP-B) No. 2683624).

However, the carrier produced with any of the above proposed methods has insufficient durability and also, is not sufficiently prevented from adhering to the photoconductor surface. Specifically, the carrier poses problems as to its durability in that, for example, the chargeability becomes unstable in accordance with the occurrence of toner spent on the carrier surface; the resistivity decreases with decreasing of the thickness of the coat layer due to ablasion; and the quality of a printed image gradually degrades in accordance with increase of running in number, although an excellent image can be obtained in an initial state. Thus, the carrier must be improved.

Meanwhile, in an attempt to prevent carrier adhesion and to improve image quality, some patent literatures disclose carriers in which the dynamic and static resistivities thereof are controlled (see, for example, JP-A No. 11-352727).

Furthermore, in recent years, image forming apparatuses have been increasingly required to form images of higher quality at a higher speed. Such a high-speed apparatus considerably applies stress to a developer used. Thus, even when the developer contains a carrier which is conventionally considered to have long service life, the service life of the developer is not sufficiently attained. Separately, carbon black is generally used as a resistivity controlling agent for the carrier. In this case, carbon black is thought to be transferred to the formed color image as a result of film delamination and/or exfoliation of the carbon black, resulting in causing color smear. Hitherto, various countermeasures against this assumed problem have been taken and have exhibited a certain preventing effect.

For example, some patent literatures disclose a carrier in which a conductive material (carbon black) is made to be present on the surface of the core material and not to be present in the resin coat layer (see, for example, JP-A No. 07-140723). Also, some patent literatures disclose a carrier in which the coat layer has a concentration gradient of carbon black (i.e., the concentration of carbon black becomes lower toward the surface the coat layer) and has no carbon black on its surface (see, for example, JP-A No. 08-179570). Further, some patent literatures disclose a dual-coat carrier in which core particles are provided with an inner resin coat layer containing conductive carbon black and the inner layer is provided thereon with an outer resin coat layer containing a white conductive material (see, for example, JP-A No. 08-286429). However, these methods cannot respond to the recent increased stress applied to the developer and sufficiently prevent color smear, which is problematic.

Obviously, one of the most effective countermeasures against color smear is to exclude carbon black responsible for it. However, as described above, when carbon black, having low electrical resistivity, is not used, the resistivity of the formed carrier increases.

In general, in use of a developer containing a carrier with high resistivity, the printed image with a large image area has a very low image density at its center portion and a high image density at only the edge portions, in other words, an image excellent in so-called edge effect can be obtained. Owing to the edge effect, characters and thin lines which are high in image sharpness can be formed, but half-tone images significantly poor in reproducibility are inconveniently formed.

As a resistivity adjuster other than carbon black, titanium oxide, zinc oxide, etc. are known. These compounds, however, cannot be comparable to carbon black in terms of reduction in resistivity of the carrier. Thus, the existing problem is not still solved, and there is still room for improvement.

BRIEF SUMMARY OF THE INVENTION

The present invention has been made in view of the foregoing; and provides a carrier for electrophotographic developer, which carrier forms an electrophotographic developer together with a negatively chargeable toner having an average circularity of 0.925 to 0.970, wherein the toner includes a resin, a colorant and an inorganic layered mineral and is granulated by dispersing and/or emulsifying an oil phase and/or a monomer phase (containing a toner composition and/or a toner composition precursor) in an aqueous medium (hereinafter the carrier for electrophotographic developer may be referred to as an "electrophotographic developer carrier" or simply to as a "carrier"), and provides an electrophotographic developer.

Specifically, an object of the present invention is to provide:

(1) an electrophotographic developer carrier and an electrophotographic developer, which have an excellent durability, which can consistently form a high-definition image without edge effect for a long period of time, and which do not cause color smear; and (2) an electrophotographic developer (oil-less dry-process developer) which attains both charge stability and low-temperature fixing property.

Further, the present invention provides an image forming method using the electrophotographic developer of the present invention; a process cartridge containing the electrophotographic developer; and an image forming apparatus having the process cartridge. Specifically, an object of the present invention is to provide:

(3) a process cartridge, image forming apparatus and image forming method, which can form a high-quality image excellent in microdot reproducibility using a toner supplied from a carrier of the electrophotographic developer and which exhibits excellent low-temperature fixing property; and in particular, (4) a process cartridge, image forming apparatus and image forming method, which attain highly reliable cleaning performance with respect to a toner supplied from a carrier of the electrophotographic developer.

The present inventors carried out extensive studies, and as a result have found that the above objects can be achieved by the following and have accomplished the present invention. Next, the present invention will be described in more detail.

Means for solving the foregoing problems are as follows:

<1> An electrophotographic developer carrier including:

a carrier core material, and a coat layer containing a binder resin and conductivity-imparted microparticles which are produced by imparting conductivity to inorganic microparticles, the coat layer being formed over the carrier core material, wherein the electrophotographic developer carrier has a static resistivity of 10 [Log (Ω·cm)] or higher and a dynamic resistivity of 9 [Log (Ω)] or lower, and is used in an electrophotographic developer together with a negatively chargeable toner having an average circularity of 0.925 to 0.970, and wherein the toner includes a resin, a colorant and an inorganic layered mineral in which at least part of interlayer ions is modified with organic ions, and is granulated by dispersing and/or emulsifying an oil phase and/or a monomer phase containing a toner composition and/or a toner composition precursor in an aqueous medium.

<2> The electrophotographic developer carrier according to <1> above, wherein a ratio of the amount of the conductivity-imparted microparticles to the amount of the carrier core material is equal to or higher than 50% of a coating rate determined by an equation given below and a ratio of the particle diameter of the conductivity-imparted microparticles (Df) to the thickness of the coat layer (h) satisfies the relation $0.5<[Df/h]<1.5$, $$\text{Coating rate}=(Ds\times\rho s\times W)/(4\times Df\times\rho f)\times 100$$

where Ds denotes a particle diameter of the carrier core material, ρs denotes a true specific gravity of the carrier core material, W denotes a ratio of the amount of the conductivity-imparted microparticles to the amount of the carrier core material, Df denotes a particle diameter of the conductivity-imparted microparticles, and ρf denotes a true specific gravity of the conductivity-imparted microparticles.

When the coating rate is adjusted to fall within the above range, toner spent on the carrier can be prevented and a change in chargeability over time is small, realizing stable charging.

<3> The electrophotographic developer carrier according to any one of <1> and <2> above, having a volume average particle diameter of 20 μm to 65 μm.

When the volume average particle diameter is adjusted to fall within the above range, carrier adhesion is remarkably prevented and image quality is remarkably improved.

<4> The electrophotographic developer carrier according to any one of <1> to <3> above, wherein the binder resin contains at least a silicone resin.

When the binder resin of the carrier contains at least a silicone resin, formation of a toner-spent product is effectively prevented.

<5> The electrophotographic developer carrier according to any one of <1> to <4> above, wherein the binder resin is a mixture of an acrylic resin and a silicone resin.

When the binder resin of the carrier is a mixture of an acrylic resin and a silicone resin, the formed coat layer is remarkably improved in adhesiveness and is prevented from abrasion and/or delamination.

<6> The electrophotographic developer carrier according to any one of <1> to <5> above, having a magnetic moment of 40 ($Am^2/kg$) to 90 ($Am^2/kg$) in an applied magnetic field of 1,000 ($10^3/4\pi\cdot A/m$).

When the magnetic moment is adjusted to fall within the above range, the attractive force acting between carrier particles is maintained to be a suitable level and thus, toner particles are efficiently dispersed in (mixed with) the carrier particles (developer). In addition, the chain of the developer is suitably formed during development.

<7> An electrophotographic developer including:

a negatively chargeable toner having an average circularity of 0.925 to 0.970, and the electrophotographic developer carrier according to any one of <1> to <6> above, wherein the toner includes a resin, a colorant and an inorganic layered mineral in which at least part of interlayer ions is modified with organic ions, and is granulated by dispersing and/or emulsifying an oil phase and/or a monomer phase containing a toner composition and/or a toner composition precursor in an aqueous medium.

<8> An image forming method including:

forming an electrostatic latent image on an image bearing member, developing the electrostatic latent image with the use of a developer so as to form a visible image, transferring the image onto a recording medium, and fixing the transferred image on the recording medium, wherein the developer is the electrophotographic developer according to <7> above.

<9> A process cartridge detachably mounted to an image forming apparatus main body, the process cartridge including:

a developing unit, and at least one unit selected from an image bearing unit (e.g., a photoconductor), a charging unit and a cleaning unit, the developing unit and the at least one unit being integrally supported, wherein the developing unit accommodates therein the electrophotographic developer according to <7> above.

<10> An image forming apparatus including:

an image bearing unit, a developing unit configured to develop an electrophotographic latent image on the image bearing unit with the use of a developer so as to form a visible image, a transfer unit configured to transfer the image onto a recording medium, and a fixing unit configured to fix the transferred image on the recording medium, wherein the image forming apparatus has the process cartridge according to <9> above.

The electrophotographic developer carrier of the present invention prevents toner spent and an increase in chargeability. In addition, the carrier exhibits excellent durability and can consistently form an edge effect-free, high-definition image without color smear over a long period of time. The electrophotographic developer formed of the carrier and the above-described negatively chargeable toner can be suitably used as an oil-less dry-process developer.

The electrophotographic developer of the present invention can be suitably used as an oil-less dry-process developer capable of attaining both charge stability and low-temperature fixing property. In addition, the developer exhibits excellent durability and avoids the occurrence of edge effect and/or color smear, forming a high-definition image over a long period of time.

The image forming method of the present invention uses the above-described electrophotographic developer and thus, achieves highly reliable cleaning performance and is excellent in low-temperature fixing property and microdot reproducibility, forming a high-quality image over a long period of time.

The process cartridge of the present invention has the above-described electrophotographic developer and thus, can form a high-quality image excellent in microdot reproducibility using a toner supplied from a carrier of the electrophotographic developer. In addition, the process cartridge achieves excellent low-temperature fixing property and highly reliable cleaning performance.

The image forming apparatus of the present invention contains the above-described process cartridge and thus, does not cause edge effect over a long period of time. The apparatus, therefore, can form a high-definition, high-quality image without color smear.

DETAILED DESCRIPTION OF THE INVENTION

Figure 1:
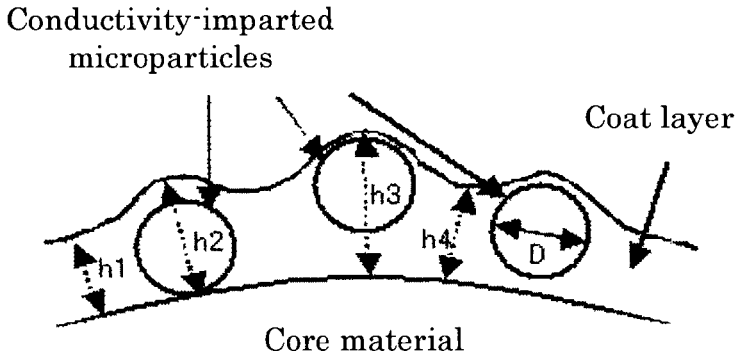
FIG. 1 schematically illustrates the relationship between the particle diameter of the conductive microparticles (Df) and the thickness of the coat layer (h) in the electrophotographic developer carrier of the present invention.

With reference to the drawings, next will be described the best mode for carrying out the present invention.

Notably, those skilled in the art can easily modify/alter the present invention claimed herein to make other embodiments, but it should be understood that the modification/alteration falls within the scope of the present invention. Also, the following exemplarily describes the best mode for carrying out the present invention and should not be construed as limiting the scope of the present invention thereto.

As described above, the electrophotographic developer carrier of the present invention includes a carrier core material and a coat layer containing a binder resin and conductivity-imparted microparticles, the coat layer being formed over the carrier core material, wherein the electrophotographic developer carrier has a static resistivity of 10 [Log (Ω·cm)] or higher and a dynamic resistivity of 9 [Log (Ω)] or lower, and is used in an electrophotographic developer together with a negatively chargeable toner having an average circularity of 0.925 to 0.970, and wherein the toner includes a resin, a colorant and an inorganic layered mineral in which at least part of interlayer ions is modified with organic ions, and is granulated by dispersing and/or emulsifying an oil phase and/or a monomer phase containing a toner composition and/or a toner composition precursor in an aqueous medium.

Hereinafter, a negatively chargeable toner, an electrophotographic developer carrier and an electrophotographic developer may be referred simply to as "toner," "carrier" and "developer," respectively.

Next, the present invention will be described in more detail.

The toner contained in the developer of the present invention will be described below in detail (see paragraph [0074]). Firstly, a modified inorganic layered mineral contained in the toner will be described, which mineral is an inorganic layered mineral produced by modifying at least part of interlayer ions with organic ions.

As used herein, the term "inorganic layered mineral" refers to an inorganic mineral in which layers with a thickness of several nanometers are stacked, and the term "modified inorganic layered mineral" refers to an inorganic layered mineral in which organic ions are introduced into ions existing between the layers. Specific examples of the inorganic layered mineral include those described in, for example, JP-A Nos. 2006-500605, 2006-503313 and 2003-202708. Such a structure is broadly encompassed by those obtained through intercalation.

Known inorganic layered minerals are, for example, smectite-group minerals (e.g., montmorillonite and saponite), kaoline-group minerals (e.g., kaolinite), magadiite and kanemite.

The hydrophilicity of an inorganic layered mineral is changed by modifying its layer structure. That is, when an unmodified inorganic layered mineral is dispersed in an aqueous medium during granulation of toner, this inorganic layered mineral is transferred into the aqueous medium, resulting in failure to form deformed (so-called non-truly-spherical) toner particles. Whereas when a modified inorganic layered mineral is used, toner particles can be readily deformed (i.e., non-truly-spherical toner particles can be readily obtained) through granulation since it has high hydrophobicity. In addition, this modified inorganic layered mineral allows toner particles to be effectively dispersed (micronized), sufficiently exhibiting a charge controlling function. In other words, such a modified inorganic layered mineral realizes micronization of toner particles during production thereof and provides non-truly-spherical toner particles. Furthermore, it exists, among others, on the surface of toner particles to exhibit a charge controlling function and contributes to improvement in low-temperature fixing property. Preferably, the amount of the modified inorganic layered mineral contained in toner materials is 0.05% by mass to 5% by mass.

The modified inorganic layered mineral used in the present invention is preferably produced by modifying, with an organic cation, an inorganic layered mineral having a smectite structure as a basic crystal structure. Although a metal anion can be introduced into an inorganic layered mineral whose divalent metals have been partially substituted with a trivalent metal, the formed inorganic layered mineral has undesirably high hydrophilicity. Thus, at least part of metal anions thereof is preferably substituted with an organic anion.

By using an organic ion modifier, at least part of ions contained in the inorganic layered mineral (at least part of interlayer ions) can be modified with organic ions. Examples of the organic ion modifier include quaternary alkyl ammonium salts, phosphonium salts and imidazolium salts, with quaternary alkyl ammonium salts being preferred.

Examples of the quaternary alkyl ammonium salt include trimethyl steary ammonium, dimethyl stearyl benzyl ammonium, dimethyl octadecyl ammonium and oleyl bis(2-hydroxyethyl)methyl ammonium.

Further examples of the organic ion modifier include sulfuric acid salts, sulfonic acid salts, carboxylic acid salts and phosphoric acid salts each having branched/unbranched or cyclic alkyl(C1 to C44), alkenyl(C1 to C22), alkoxy(C8 to C32), hydroxyalkyl(C2 to C22), ethylene oxide and/or propylene oxide. In particular, carboxylic acids having an ethylene oxide skeleton are preferred.

Through modifying at least part of interlayer ions with organic ions, the obtained modified inorganic layered mineral has a suitable hydrophobicity. Thus, when this modified inorganic layered mineral is incorporated into an oil phase containing a toner composition and/or toner composition precursor, the oil phase exhibits non-Newtonian viscosity, resulting in forming deformed toner particles. As mentioned above, the amount of the modified inorganic layered mineral contained in toner materials is preferably 0.05% by mass to 5% by mass.

The modified inorganic layered mineral can be appropriately selected. Examples thereof include montmorillonite, bentnite, hectorite, attapulgite, sepiolite and mixtures thereof. In particular, organic modified montmorillonite and bentnite are preferred, from the viewpoints of giving no adverse effects to characteristics of the formed toner, of allowing easy control of viscosity, and of attaining desired effects in even a small amount.

Examples of commercially available modified inorganic layered minerals in which at least part of interlayer ions is modified with an organic cation include quaternium 18 bentnite such as Bentone 3, Bentone 38, Bentone 38V (these products are of Leox Co.), Thixogel VP (product of United Catalyst Co.), Clayton 34, Clayton 40 and Clayton XL (these products are of Southern Clay Products, Inc.); stearalkonium bentonite such as Bentone 27 (product of Leox Co.), Thixogel LG (product of United Catalyst Co.), Clayton AF and Clayton APA (these products are of Southern Clay Products, Inc.); and quaternium 18/benzalkonium bentonite such as Clayton HT and Clayton PS (these products are of Southern Clay Products, Inc.). Of these, Clayton AF and Clayton APA are particularly preferred.

Meanwhile, modified inorganic layered minerals in which at least part of interlayer ions is modified with an organic anion are particularly preferably produced by modifying DHT-4A (product of Kyowa Chemical Industry Co.) with an organic anion represented by the following General Formula (1). Examples of the compound represented by General Formula (1) include Hightenol 330T (product of Dai-ichi Kogyo Seiyaku Co.), $$R_1(OR_2)nOSO_3M \qquad \text{General Formula (1)}$$

where $R_1$ represents an alkyl group having 13 carbon atoms, $R_2$ represents an alkylene group having 2 to 6 carbon atoms, n is an integer of 2 to 10, and M represents a monovalent metal.

During production for toner, use of the modified inorganic layered mineral with a suitable hydrophobicity allows a toner composition and/or toner composition precursor-containing oil phase to exhibit non-Newtonian viscosity, resulting in forming deformed toner particles.

Meanwhile, when the modified inorganic layered mineral used in the present invention is used for producing a two-component developer (toner+carrier), the carrier changes in chargeability over time (note that the mechanism is not clear). Specifically, the chargeability tends to increase with increasing of the amount of toner consumed. The reason for this is believed to lie in that toner components adhere or accumulate on the carrier surface (toner spent), but the mechanism to describe an increase of chargeability is unclear in detail.

In toner spent phenomenon with the use of commonly used toner components, chargeability usually decreases. In contrast, in toner spent with the use of toner components in the present invention, chargeability increases. The chargeability does not considerably change in printing of a chart with a small image area (e.g., characters), but increases in printing of a chart with a large image area (e.g., a photograph and a poster image). That is, printing of a chart with a large image area consumes a large amount of toner, and the chargeability increases with increasing of the amount of toner consumed.

Thus, the toner-spent product must be removed from the carrier surface. In view of this, the present invention provides a carrier including a carrier core material, and a coat layer containing a binder resin and conductive microparticles, the coat layer being formed on the core material. The conductive microparticles contained in the coat layer can provide the carrier surface with irregularities and thus, the toner-spent product is removed through self-polishing of carriers. If the toner-spent product is not sufficiently removed, the developer still has high chargeability. Such a developer further increases in its chargeability after development, making it difficult to be released from a development sleeve by the action of image force. As a result, the developer is entrained on the development sleeve. Through entrainment of the low-toner-concentration developer given after development, the density of the formed image problematically decreases in the rotating direction of the development sleeve. Meanwhile, in order to prevent generation of image force caused by increased chargeability after development, the resistivity of the carrier must be decreased. But, the carrier having lowered resistivity causes development thereof (solid carrier adhesion) due to electrostatic induction. Even when such solid carrier adhesion is prevented with any means in an initial state, film delemination proceeds in accordance with repetitive use and the carrier decreases in resistivity, resulting in causing the solid carrier adhesion. As is clear from the above, difficulty is encountered in preventing entrainment of the developer on the development sleeve, preventing the occurrence of solid carrier adhesion, and extending the service life of the developer. In order to overcome the above difficulty, in the present invention, conductivity-imparted microparticles are incorporated into a coat layer and the formed carrier is controlled to have, in its dispersion state, a static resistivity of 10 [Log (Ω·cm)] or higher and a dynamic resistivity of 9 [Log (Ω)] or lower.

The present invention uses conductivity-imparted microparticles instead of intrinsically conductive microparticles (e.g., titanium oxide, zinc oxide and carbon black). The conductivity-imparted microparticles can be formed from surface-treated inorganic microparticles (e.g., tin oxide-antimony oxide and tin oxide-indium oxide). But, if conductive microparticles other than colorless or white conductive microparticles are mixed in the toner as a result of delamination of the coat layer, color smear is caused in forming a color image.

Zinc oxide and titanium oxide assume white, but cannot effectively reduce the chargeability of the carrier, unlike carbon black, even in a small amount and thus, they must be incorporated into the coat layer in a large amount. Incorporation of a large amount of conductive microparticles causes a problem in that the microparticles are unevenly distributed in the coat layer. As a result, sufficient adhesiveness cannot be obtained between the conductive microparticles and the resin forming the coat layer, and the microparticles are exposed along with delamination of the layer. The exposed site acts as an electric leak point to locally decrease resistivity, whereby carrier adhesion occurs in an image portion to form an abnormal image having white voids, etc. Also, in use of carbon black, zinc oxide, titanium oxide and similar conductive microparticles, the formed carrier, in its dispersion state, can control to have a static resistivity of 10 [Log (Ω·cm)] or higher and a dynamic resistivity of 9 [Log (Ω)] or lower in an initial state. After repetitive use, although the dynamic resistivity is maintained to be the value, the static resistivity undesirably decreases, thereby imparting the desired relationship between them. In contrast, use of conductivity-imparted microparticles can provide the desired relationship even after repetitive use (the mechanism is not clear). Supposedly, the reason for this lies in that stress applied in use delaminates not only the coat layer but also the conductive portion of the conductivity-imparted microparticles to expose inorganic microparticles serving as a base material. In general, the thinner the coat layer, the lower the static resistivity. In this case, however, high-resistive inorganic microparticles (base material) are exposed to avoid a decrease in static resistivity. Also, such an effect may not be obtained depending on the dispersion state of the conductivity-imparted microparticles in the coat layer.

The present invention uses conductivity-imparted microparticles for the purpose of attaining desired relationship between the dynamic resistivity and the static resistivity after repetitive use. During use, stress applied delaminates not only the coat layer (resin) but also the conductive portion of the conductivity-imparted microparticles to expose inorganic microparticles serving as a base material. As described above, the thinned coat layer generally decreases in static resistivity, but in this case, the static resistivity do not decrease since electrical circuit is blocked with exposed high-resistive inorganic microparticles. Meanwhile, titanium oxide, zinc oxide and carbon black are unchanged in resistivity at any portion. Thus, when these microparticles are used, the resistivity of the coat layer depends on the thickness thereof.

The inorganic base microparticles of the conductivity-imparted microparticles are highly resistive and preferably have a specific powder resistivity of 9 or more. The formed conductivity-imparted microparticles preferably have a specific powder resistivity of 7 or less.

Figure 6:
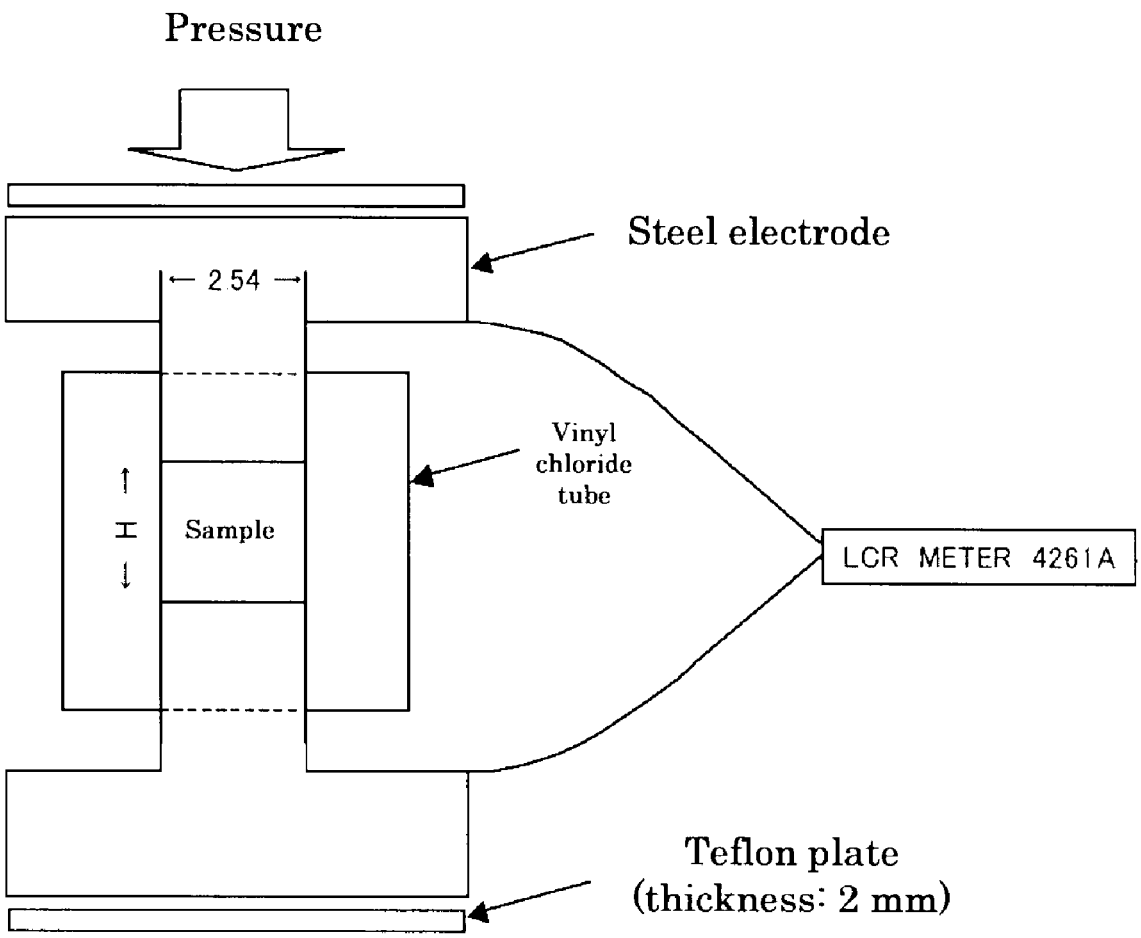
FIG. 6 is an explanatory view of a specific powder resistivity measuring device.

The specific powder resistivity can be measured as follows. As shown in FIG. 6, a sample of 5 g is placed in a cylindrical vinyl chloride tube (inner diameter: 1 inch) and the tube is sandwiched between electrodes. Subsequently, the electrodes are pressurized with a pressing machine at 10 kg/cm$^2$. In this pressurized state, the resistivity (r) of the sample is measured with an LCR meter (Yokokawa-HEWLETT-PACKARD 4216A). The obtained resistivity and the following equation (1) are used to determine the specific powder resistivity, $$\text{Specific powder resistivity } (\Omega\cdot\text{cm})=(2.54/2)^2\times(\pi/H\times r) \quad (1)$$

where H denotes the thickness of a sample and r denotes the resistivity thereof.

Figure 2:
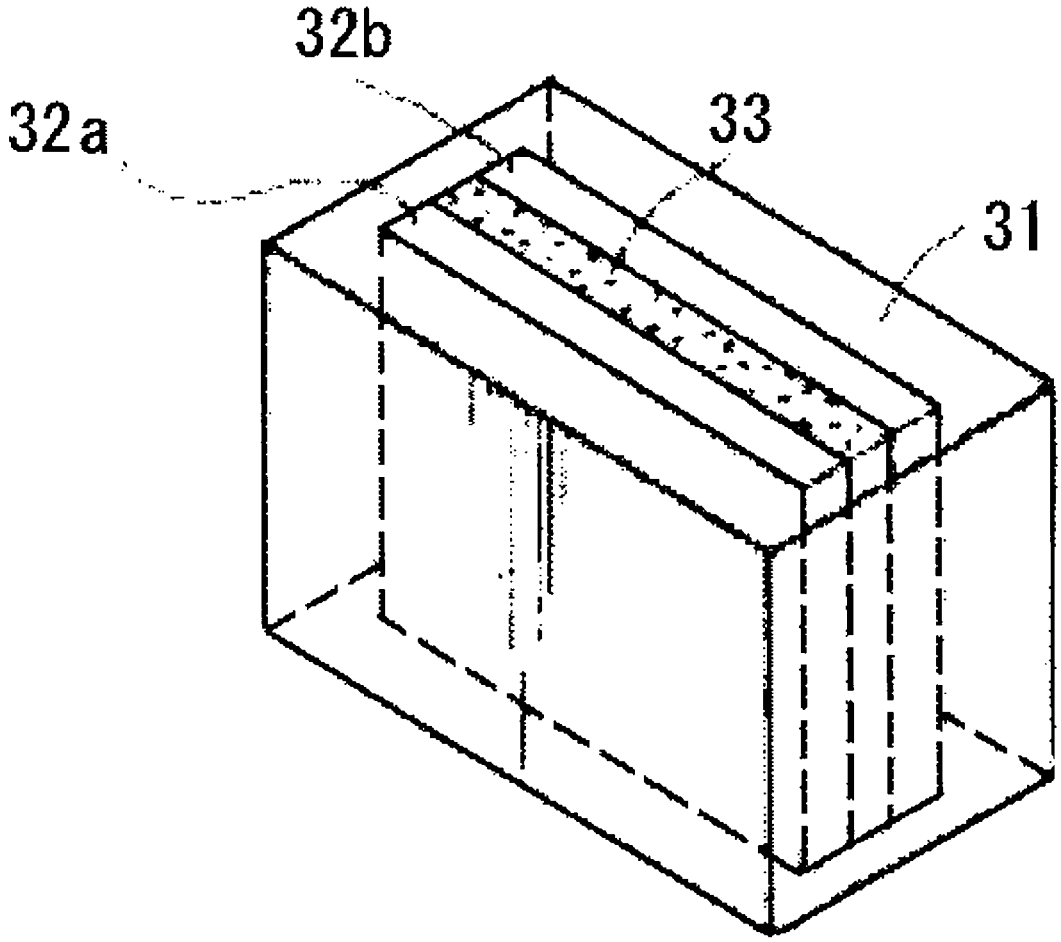
FIG. 2 schematically illustrates the configuration of a carrier-resistivity measuring apparatus for measuring the static resistivity of the electrophotographic developer carrier of the present invention.

The static resistivity (specific volume resistivity) of the electrophotographic developer carrier of the present invention is measured using a carrier-resistivity measuring apparatus schematically shown in FIG. 2, and is preferably 10 [Log (Ω·cm)] to 16 [Log (Ω·cm)]. The static resistivity is not particularly limited, so long as it falls within the above range, and can be adjusted depending on the purpose. The resistivity of the carrier must be adjusted in a system in which a high-quality color image is intended to be obtained.

When the specific volume resistivity is less than 10 [Log (Ω·cm)], the carriers adhere to a non-image portion; whereas when the specific volume resistivity is more than 16 [Log (Ω·cm)], edge effect is observed at an unallowable level. Needless to say, both cases are not preferred. Notably, when it is below the measurable lower limit of a high resistance meter used, the specific volume resistivity cannot be substantially obtained and regarded as breakdown.

In the present invention, the specific volume resistivity is determined as follows. Specifically, carriers (33) are charged into a fluorine-resin cell (31) having 2 cm×4 cm electrodes (32*a*) and (32*b*) which are disposed 2 mm apart; the cell is tapped with a tapping machine (model PTM-1, product of SANKYO PIO-TECH, CO., Ltd.) at a tapping speed of 30 times/min for 1 min; a DC voltage of 1,000V is applied between the electrodes; a DC resistance is measured with a high resistance meter 4329A (4329A+LJK5HVLVWDQFH0HWHU, product of Yokokawa-HEWLETT-PACKARD); an electrical resistivity R (Ω·cm) is calculated from the obtained resistance; and the Log R is obtained from the electrical resistivity R.

Figure 3:
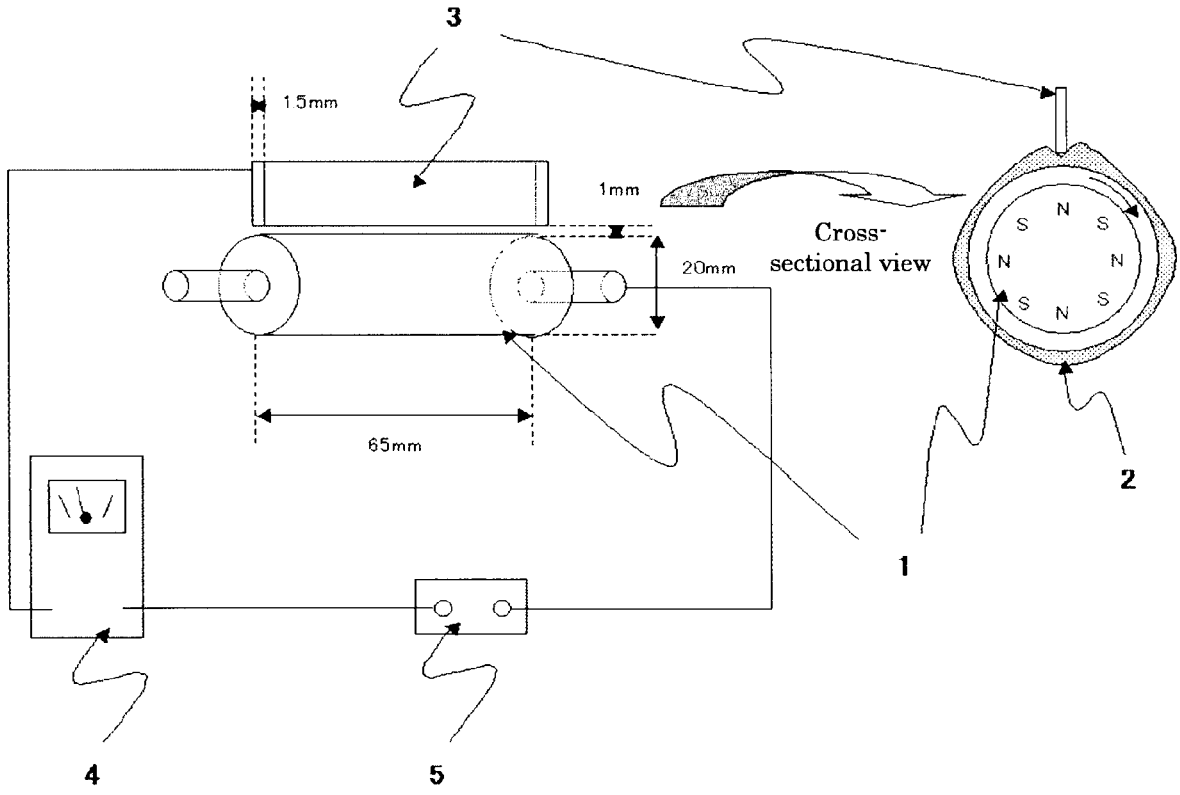
FIG. 3 schematically illustrates the configuration of a carrier-resistivity measuring apparatus for measuring the dynamic resistivity of the electrophotographic developer carrier of the present invention.

In the present invention, the dynamic resistivity of the electrophotographic developer carrier of the present invention is measured using a carrier-resistivity measuring apparatus schematically shown in FIG. 3, and is preferably 6 [Log (Ω·cm)] to 9 [Log (Ω·cm)]. The dynamic resistivity is not particularly limited, so long as it falls within the above range, and can be adjusted depending on the purpose. The resistivity of the carrier must be adjusted in a system in which a high-quality color image is intended to be obtained.

When the dynamic resistivity is more than 9 [Log (Ω·cm)], as described above, it is difficult for the developer to be released from a development sleeve (1) by the action of image force. As a result, the developer is entrained on the development sleeve (1). Through entrainment of the low-toner-concentration developer given after development, the density of the formed image problematically decreases in the rotating direction of the development sleeve. Meanwhile, use of the carrier with a dynamic resistivity less than 6 [Log (Ω·cm)] causes, during development, a discharge from the development sleeve to the photoconductor (image bearing unit), resulting in forming an abnormal image. Notably, when a discharge occurs during measurement, the dynamic resistivity cannot be substantially obtained and regarded as breakdown.

The dynamic resistivity of the carrier is calculated from an electrical resistivity R (Ω) thereof. This electrical resistivity R (Ω) is calculated from a dynamic current value thereof. This dynamic current value can be measured with an apparatus schematically shown in FIG. 3 at a DC voltage of 2,000V applied between the electrodes. Specifically, carriers (2) are deposited on a sleeve (1) and then a voltage of 2,000V is applied with a DC power source (5) while rotating the sleeve (1) at 250 rpm. The electrical current flowing through the sleeve (1), carriers (2) and a restrain blade (3) is measured with an ammeter (4). The measurement conditions are as follows.

Distance between restrain blade and sleeve: 1.0 mm
Rotating speed of sleeve: 250 rpm
Voltage applied: 2,000V
Sample amount on sleeve: 20.0 g (0.490 g/cm$^2$)

In this measurement, a multimeter (model 27, product of Fluke Corp.) is used.

As described above, the carrier contained in the electrophotographic developer of the present invention has, on a carrier core material, a coat layer containing a binder resin and conductive microparticles.

Examples of the carrier core material (hereinafter may be abbreviated as a "core material") used in the present invention include known carriers of a two-component electrophotographic developer. Specific examples include, but not limited to, ferrite, Cu—Zn ferrite, Mn ferrite, Mn—Mg ferrite, Mn—Mg—Sr ferrite, magnetite, iron and nickel. The core material used may be appropriately selected from these materials depending on the purpose.

The coat layer preferably contains conductivity-imparted microparticles in an amount as reduced to a coating rate of 50% or higher with respect to the carrier core material. Specifically, a ratio of the amount of the conductivity-imparted microparticles to the amount of the carrier core material is preferably equal to or higher than 50% of a coating rate determined by the following equation (2).

$$\text{Coating rate}=(Ds\times\rho s\times W)/(4\times Df\times\rho f)\times 100 \quad (2)$$

where Ds denotes a particle diameter of the carrier core material, ρs denotes a true specific gravity of the carrier core material, W denotes a ratio of the amount of the conductivity-imparted microparticles to the amount of the carrier core material, Df denotes a particle diameter of the conductivity-imparted microparticles, and ρf denotes a true specific gravity of the conductivity-imparted microparticles When the coating rate is 50% or higher, irregularities are formed on the surface of the carriers. Thus, when the developer containing such carriers is stirred so as to be frictionally charged, the binder resin does not receive strong impact during friction between carrier and toner or between carriers. This can prevent toner spent on the carrier.

The coating rate is calculated as follows.

Specifically, the true specific gravity ρf of the conductive microparticles and the true specific gravity ρs of the carrier core material are individually measured using a dry automatic bulk density meter ACUPIC 1330 (product of Shimadzu Corporation). The particle diameter Ds (volume average particle diameter) of the carrier core material is measured using a Microtrack particle size analyzer of SRA type (product of Nikkiso Co.). In this analyzer, the range is set to 0.7 μm to 125 μm; methanol is used as a dispersion medium; and the refractive index is set to 1.33 and the refractive indices of carriers and core materials are set to 2.42.

The particle diameter Df of conductive microparticles (volume average particle diameter) is measured with an automatic particle size analyzer CAPA-700 (product of Horiba, Ltd.). Before measurement, aminosilane (30 mL) (SH6020, product of Dow Corning Toray Silicone Co.) and a toluene solution (300 mL) are placed in a juicer; a sample of 6.0 g is added the juicer, followed by dispersing at a rotation speed set to low for 3 min; the dispersion is added in an appropriate amount to a 1,000 mL-beaker containing toluene (500 mL) for dilution; and the diluted liquid is continued to be stirred with a homogenizer. The thus-pretreated diluted liquid is measured with a super-centrifugal automatic particle size analyzer CAPA-700.

[Measurement Conditions]

Rotation speed: 2,000 rpm

Maximum particle size: 2.0 μm

Minimum particle size: 0.1 μm

Pitch of particle size: 0.1 μm

Viscosity of dispersion medium: 0.59 mPa·s

Density of dispersion medium: 0.87 g/cm$^3$

Density of particles: true specific gravity measured using a dry automatic bulk density meter ACUPIC 1330 (product of Shimadzu Corporation)

When the coating rate is less than 50%, the surface of the carrier core material is highly likely to be exposed through film delamination occurring over time, resulting in locally causing a drop in resistivity. When a developer containing such a carrier is used for forming a solid image, the formed solid image tends to have white voids. This is considerably observed when the coating rate is less than 40%.

Also, when the ratio of the particle diameter of the conductive microparticles contained in the carrier-coat layer (Df) to the thickness of the coat layer (h) (i.e., Df/h) satisfies the relation $0.5<[Df/h]<1.5$, advantageous effects can be remarkably obtained.

Specifically, when the ratio Df/h falls within a range of 0.5 (exclusive) to 1.5 (exclusive), a higher proportion of protrusions are formed on the coat layer. Thus, when the developer containing such carriers is stirred so as to be frictionally charged, the binder resin does not receive strong impact during friction between carrier and toner or between carriers.

This can prevent delamination of the binder resin film, which delamination may lead to undesired charging. In addition, a number of protrusions are formed on the coat layer (i.e., carrier surface) and thus, toner spent can be effectively prevented; i.e., a toner-spent product is cleaned. This is because the carriers are frictionally brought into contact with one another and the toner-spent product adhering to the carrier surface can be effectively scraped off.

When the ratio [Df/h] is lower than 0.5, the microparticles undesirably tend to be embedded in the binder resin. In particular, when the [Df/h] is lower than 0.4, such an adverse effect is considerably exhibited.

When the ratio [Df/h] is higher than 1.5, the microparticles come into contact with the binder resin at a smaller surface area and are not firmly supported by the resin, resulting in undesired exfoliation of the microparticles. Such exfoliation may cause decrease in resistivity.

FIG. 1 schematically illustrates the particle diameter (Df) of the conductive microparticles and the thickness (h) of the coat layer in the electrophotographic developer carrier of the present invention.

The thickness h of the coat layer can be determined as follows: the cross section of the carrier is observed with a transmission electron microscope (TEM) to measure the thickness of resin of the coat layer; and the obtained values are averaged. Specifically, only resin present between the core material surface and the particles is measured for its thickness, and resin present between particles or above conductive microparticles is not taken into account. Through observation of the cross section of the carrier, the resin thicknesses is measured at randomly selected 50 sites and the measurements are averaged to determine the thickness h of the coat layer (μm). The particle diameter (Df) of the conductive microparticles is measured using the aforementioned super-centrifugal automatic particle size analyzer CAPA-700.

The carrier of the present invention preferably has a volume average particle diameter of 20 μm to 65 μm. When the volume average particle diameter falls within the above range, the carrier is effectively prevented from adhesion. In addition, other advantageous effects (e.g., improvement in image quality) can be remarkably obtained. When it is less than 20 μm, uniformity of the particles undesirably decreases and no image forming apparatus can sufficiently handle them, resulting in causing carrier adhesion. Whereas when it is more than 65 μm, reproducibility in a fine image portion degrades and thus, a high-definition image cannot be obtained. Needless to say, both cases are not preferred.

The volume average particle diameter of the carrier is measured using a Microtrack particle size analyzer of SRA type (product of Nikkiso Co.). In this analyzer, the measurement range is set to 0.7 μm to 125 μm; methanol is used as a dispersion medium; and the refractive index is set to 1.33 and refractive indices of carriers and core materials are set to 2.42.

The binder resin of the carrier preferably contains at least a silicone resin. Use of such a binder resin gives remarkably advantageous effects. Specifically, since a silicone resin has low surface energy, toner spent is difficult to occur. In addition, film delamination is likely to occur, effectively avoiding accumulation of the toner-spent product.

In the present invention, the silicone resin may be any conventionally known silicone resins. Examples thereof include, but not limited to, straight silicone resins formed exclusively of organosiloxane bonds; and alkyd-, polyester-, epoxy-, acrylic-, and urethane-modified silicone resins.

Examples of commercially available products of the above straight silicone resins include KR271, KR255, KR152 (these products are of Shin-Etsu Chemical Co.), SR2400, SR2406 and SR2410 (these products are of Dow Corning Toray Silicone Co.). The silicone resin may be used alone or in combination with other components (e.g. a component crosslinkable therewith and a charge controlling component). Meanwhile, examples of commercially available products of the above modified silicone resin include KR206 (alkyd-modified), KR5208 (acryl-modified), ES1001N (epoxy-modified), KR305 (urethane-modified) (these products are of Shin-Etsu Chemical Co.), SR2115 (epoxy-modified) and SR2110 (alkyd-modified) (these products are of Dow Corning Toray Silicone Co.).

Also, the binder resin of the carrier may be a mixture of an acrylic resin and a silicone resin. When an acrylic resin is used in combination with a silicone resin, advantageous effects (e.g., improvement in adhesiveness of the coat layer) can be remarkably obtained. Specifically, an acrylic resin has strong adhesiveness and low brittleness, and therefore, it exhibits very excellent wear resistance. Thus, when such an acrylic resin is incorporated into the binder resin, film delamination/exfoliation is effectively prevented; i.e., a stable coat layer is formed. In addition, conductive microparticles and other particles can be firmly retained in the coat layer by virtue of strong adhesiveness of the acrylic resin. In particular, the acrylic resin-containing binder can remarkably effectively retain microparticles having a particle diameter larger than the thickness of the coat layer.

In the present invention, the acrylic resin is not particularly limited and may be any resins having an acrylic component. The acrylic resin may be used alone or in combination with at least one component crosslinkable therewith. Examples of the crosslinkable component include, but not limited to, amino resins and acidic catalysts.

Examples of the amino resin include, but not limited to, guanamine resins, and melamine resins. The acidic catalyst may be any ones having a catalytic effect. Examples thereof include, but not limited to, completely alkylated catalysts and catalysts having a reactive group such as a methylol group, imino group, methylol/imino group. As described above, an acrylic resin has strong adhesiveness and low brittleness and therefore, exhibits very excellent wear resistance. But, it has high surface energy and thus, may undesirably cause a decrease in charge amount due to toner spent (accumulation) when used in combination with toner easily causing toner spent. This problem can be solved by using a silicone resin in combination. That is, the silicone resin has low surface energy and does not easily cause toner spent. Furthermore, film delamination occurs to prevent proceeding of accumulation of the toner-spent product. The silicone resin, however, exhibits weak adhesiveness and high brittleness and therefore, exhibits poor wear resistance. Thus, it is important for these two resins to desirably contribute to the property of the binder resin. Use of these resins in a desired mixing ratio can provide a coat layer which do not virtually cause toner spent and which has high wear resistance.

Also, the carrier of the present invention preferably has a magnetic moment of 40 ($Am^2/kg$) to 90 ($Am^2/kg$) in an applied magnetic field of 1,000 ($10^3/4\pi \cdot A/m$).

Hereinafter, the intensity of the applied magnetic field may be expressed with Oe (Oersted). Note that 1 kOe (1,000 Oersted) correspond to 1,000 ($10^3/4\pi \cdot A/m$).

When the magnetic moment falls within the above range, the attractive force acting between carrier particles is maintained to be a suitable level and thus, toner particles are advantageously rapidly dispersed in (mixed with) the carrier particles (developer). When it is less than 40 $Am^2/kg$, carrier adhesion occurs. Whereas when it is more than 90 $Am^2/kg$, the chain formed of the developer during development is too stiff and thus, reproducibility in a fine image portion degrades, resulting in that a high-definition image cannot be obtained. Needless to say, both cases are not preferred.

The magnetic moment can be measured with a B-H tracer (BHU-60, product of Riken Denshi Co.) as follows. Specifically, carrier core material particles (1.0 g) are charged into a cylindrical cell (inner diameter: 7 mm, height: 10 mm) and the cell is set to the tracer. In this tracer, the first magnetic field is gradually increased to 3,000 Oersted and then gradually decreased to 0 Oersted. Next, the second magnetic field, which is an opposite direction to the first magnetic field, is gradually increased to 3,000 Oersted and then gradually decreased to 0 Oersted. In this state, the first magnetic field is applied again to give a B-H curve. The magnetic moment at 1,000 Oersted is calculated based on the thus-obtained B-H curve.

Next will be described in detail the toner used in the developer of the present invention.

[Toner]

The toner used in the developer of the present invention is a negatively chargeable toner having an average circularity of 0.925 to 0.970, including a resin, a colorant and an inorganic layered mineral in which at least part of interlayer ions is modified with organic ions, and being granulated by dispersing and/or emulsifying an oil phase and/or a monomer phase containing at least a toner composition and/or a toner composition precursor in an aqueous medium.

This toner exhibits highly reliable cleaning performance, excellent low temperature fixing property, and excellent microdot reproducibility. Use thereof can consistently provide high-quality images.

As described above, the toner of the present invention preferably has an average circularity 0.925 to 0.970, more preferably 0.945 to 0.965. Notably, the circularity is obtained as follows: a circle having the same area as the project area of the sample is obtained; and the circumference of the circle is divided by that of the sample.

In the toner, the amount of particles having an average circularity less than 0.925 is preferably 15% or lower. The toner having an average circularity less than 0.925 cannot exhibit satisfactorily transferability and provide high-quality images with no dusts. Meanwhile, the toner having an average circularity more than 0.970 is not sufficiently removed from, for example, a photoconductor (image bearing unit) and a transfer belt provided in an image forming apparatus employing a cleaning blade, and such cleaning failure causes smear on the image formed. For example, when toner is not transferred due to, for example, paper-feed failure during formation of an image having a high image area ratio (e.g., photographic image), the toner is accumulated on the photoconductor surface, causing color smear and/or staining, for example, a charging roller used for contact-charging the photoconductor. As a result, the charging roller may not exhibit intrinsic charging ability.

The average circularity can be determined with, for example, an optical detection zone method as follows. Specifically, while passing a toner-containing suspension through an image-detection zone disposed on a flat board, the image of the particles is optically detected with a CCD camera, followed by analyzing of the obtained image. In this measurement, there can be used a flow-type particle image analyzer FPIA-2100 (product of Sysmex Corp.).

In the toner contained in the electrophotographic developer of the present invention, the ratio of volume average particle diameter (Dv) to number average particle diameter (Dn) (i.e., Dv/Dn) is preferably 1.00 to 1.30. When the ratio falls within the above range, a high-resolution, high-quality image can be obtained.

Furthermore, when used in a two-component developer, such a toner exhibits less variation in its particle diameter even after repetitive cycles of consumption and addition thereof. In addition, the toner is not adversely affected through long-term stirring in a developing device and can maintain stable, excellent developability.

When the ratio Dv/Dn is higher than 1.30, a variation in particle diameter becomes large between toner particles and, during development, etc., the toner particles exhibit different behaviors. As a result, microdot reproducibility is degraded, whereby a high-quality image cannot be obtained. More preferably, the ratio Dv/Dn is 1.00 to 1.20. When the ratio falls within this range, a more excellent image can be obtained.

In the present invention, the toner preferably has a volume average particle diameter Dv of 3.0 μm to 7.0 μm. In general, the particle diameter of toner is advantageously smaller to the greatest extent possible from the viewpoint of forming a high-resolution, high-quality image. In contrast, such toner that has a small particle diameter is disadvantageous from the viewpoints of exhibiting sufficient transferability and performing sufficient cleaning. Also, when the toner having a volume average particle diameter smaller than 3.0 μm is used in a two-component developer, such a toner is fused on the carrier surface through long-term stirring in a developing device to reduce the chargeability of the carrier. Meanwhile, when used as a one-component developer, filming of the toner to a development roller is caused. In addition, the toner tends to fuse on and adhere to, for example, a cleaning blade.

Also, this phenomenon is attributed greatly to the amount of particles of 2 μm or smaller contained in the toner. Specifically, the amount is higher than 20% thereof, undesired adhesion to the carrier occurs. In addition, high charge stability cannot be attained.

In contrast, the toner having a volume average particle diameter larger than 7.0 μm cannot provide a high-resolution, high-quality image and also, often exhibits large variation in its particle diameter after repetitive cycles of consumption and addition thereof. Furthermore, the same as described above is found to be observed when the ratio Dv/Dn is greater than 1.30.

Next will be described the relation between the shape of toner and the transferability thereof.

The amount of toner adhering to the photoconductor (image bearing member) is larger in full-color copiers using a plurality of color toners for development than in monochrome copiers using only a black toner. Thus, when a conventional amorphous toner is used in full-color copiers, transfer efficiency is difficult to enhance.

In addition, a usual amorphous toner adheres to the surface of the photoconductor/intermediate transfer member or causes filming thereon, frequently degrading transfer efficiency. This is because such a usual amorphous toner tends to generate a rubbing or sliding force between the photoconductor and the cleaning member, between the intermediate transfer member and the cleaning member, and/or between the photoconductor and the intermediate transfer member. Furthermore, in formation of a full-color image, toner images of four colors are not successfully transferred. Also, in use of an intermediate transfer member, color unevenness or undesired color balance tends to be observed, making it difficult to consistently output high-quality, full-color images.

As described above, small, uniform toner particles have a problematic cleaning performance. Preferably, toner particles having a circularity of 0.950 or less account for 20% to 80% of all the toner particles. Such toner exhibits desired blade-cleaning performance and desired transfer efficiency at the same time. The blade-cleaning performance depends greatly on the material of the blade and/or on the contact state thereof. Similarly, the transfer efficiency (transferability) varied with the process conditions employed. Thus, the amount of toner particles having a circularity of 0.950 or less may be adjusted within the above range depending on the process to be performed.

When the ratio of toner particles having a circularity of 0.950 or less to all the toner particles is lower than 20%, the formed toner is difficult to clean with a blade. Whereas when the ratio is higher than 80%, the above-described undesired transferability is observed. Specifically, such toner particles contain deformed toner particles in an excessively high proportion and thus, during transfer, they cannot be smoothly moved, for example, from an image bearing member surface to a transfer paper or intermediate transfer belt and/or from a first intermediate transfer belt to a second intermediate transfer belt. In addition, these toner particles exhibit different behaviors. For the above reasons, uniform, high transfer efficiency cannot be obtained. Furthermore, the toner particles become unstable in chargeability and also become brittle as time passes. As a result, fine powder is formed in the developer, leading to decrease in durability thereof.

Next will be described the method for measuring properties of the toner used in the present invention.

(Ratio of Particles with a Particle Diameter of 2 μm or Less and Circularity)

In the toner used in the present invention, the ratio of particles with a particle diameter of 2 μm or less, and its circularity and average circularity can measured using a flow-type particle image analyzer FPIA-2000 (product of Sysmex Corp.).

Specifically, solid impurities are removed from water and the thus-treated water (100 mL to 150 mL) is placed in a container. Subsequently, a surfactant (0.1 mL to 0.5 mL), preferably alkyl benzene sulfonate, is added as a dispersant to the container and then a measurement sample of about 0.1 g to 0.5 g is added thereto. The resultant suspension is dispersed with an ultrasonic wave disperser for about 1 min to 3 min to adjust the density of the sample to 3,000 to 10,000/μL, followed by analyzing for the shape and distribution of the sample (toner particles).

(Particle Diameter of Toner)

The average particle diameter and particle size distribution of the toner particles are measured through the Coulter counter process. For example, the particle size distribution can be measured with a Coulter Counter TA-II or Coulter Multisizer II (these products are of Beckman Coulter, Inc.). In the present invention, the Coulter Counter TA-II was used with being connected to an interface (product of The Institute of Japanese Union of Scientists & Engineers), which outputs number and volume distributions, and to a personal computer (PC9801, product of NEC Co.).

Next, the measurement method will be described.

Firstly, a surfactant (0.1 mL to 5 mL), preferably alkylbenzene sulfonate, is added as a dispersant to an aqueous electrolyte solution (100 mL to 150 mL). Here, the aqueous electrolyte solution is an about 1% NaCl aqueous solution prepared using 1st grade sodium chloride, and examples of commercially available products thereof include ISOTON-II (product of Beckman Coulter, Inc.). Subsequently, a measurement sample of 2 mg to 20 mg is added to the above-obtained electrolyte solution. The resultant electrolyte solution with the sample being suspended is dispersed with an ultrasonic wave disperser for about 1 min to 3 min. The thus-obtained dispersion is analyzed with the above-described apparatus using an aperture of 100 μm to measure the number and volume of the toner particles (toner). Then, the volume particle size distribution and number particle size distribution are calculated from the obtained values.

Notably, in this measurement, 13 channels are used: 2.00 μm (inclusive) to 2.52 μm (exclusive); 2.52 μm (inclusive) to 3.17 μm (exclusive); 3.17 μm (inclusive) to 4.00 μm (exclusive); 4.00 μm (inclusive) to 5.04 μm (exclusive); 5.04 μm (inclusive) to 6.35 μm (exclusive); 6.35 μm (inclusive) to 8.00 μm (exclusive); 8.00 μm (inclusive) to 10.08 μm (exclusive); 10.08 μm (inclusive) to 12.70 μm (exclusive); 12.70 μm (inclusive) to 16.00 μm (exclusive); 16.00 μm (inclusive) to 20.20 μm (exclusive); 20.20 μm (inclusive) to 25.40 μm (exclusive); 25.40 μm (inclusive) to 32.00 μm (exclusive); and 32.00 μm (inclusive) to 40.30 μm (exclusive); i.e., particles having a particle diameter of 2.00 μm (inclusive) to 40.30 μm (exclusive) are subjected to the measurement. The volume average particle diameter (Dv) and number average particle diameter (Dn) are calculated from the obtained volume particle size distribution and number particle size distribution, respectively, and the ratio Dv/Dn is determined.

As described above, the toner used in the present invention is particularly preferably granulated by dispersing and/or emulsifying an oil phase and/or a monomer phase containing at least a toner composition and/or a toner composition precursor in an aqueous medium. The resin contained in the toner (binder resin) is preferably a polyester resin as described below in detail.

From the studies performed by the present inventors, in order for the formed toner to exhibit excellent low-temperature fixing property and offset resistance after modification with a prepolymer, THF soluble matter of the acidic group-containing polyester resin used preferably has a weight average molecular weight of 1,000 to 30,000. When the weight average molecular weight is lower than 1,000, the ratio of oligomers increases, leading to degradation of the heat resistance during storage. Whereas when it is higher than 30,000, modification with a prepolymer is not sufficiently carried out due to steric hindrance, leading to degradation of the offset resistance.

In the present invention, the molecular weight is measured through gel permeation chromatography (GPC) as follows.

A column is conditioned in a heat chamber at 40° C., and then THF (solvent) is caused to pass through the column at a flow rate of 1 mL/min while the temperature is maintained. Subsequently, a separately prepared THF solution of a resin sample (concentration: 0.05% by mass to 0.6% by mass) is applied to the column in an amount of 50 μL to 200 μL. In the measurement of the molecular weight of the sample, the molecular weight distribution is determined based on the relationship between the logarithmic value and the count number of a calibration curve given by using several monodisperse polystyrene-standard samples. The standard polystyrenes used for giving the calibration curve may be, for example, those available from Pressure Chemical Co. or Tosoh Co.; i.e., those each having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$. Preferably, at least about 10 standard polystyrenes are used for giving the calibration curve. The detector used is a refractive index (RI) detector.

Also, when a polyester resin (a first binder resin) has an acid value of 1.0 (KOHmg/g) to 50.0 (KOHmg/g), the formed toner can be improved through addition of a basic compound in characteristics such as particle size controllability, low-temperature fixing property, hot-offset resistance, heat resistance during storage and charging stability. When the acid value is higher than 50.0 (KOHmg/g), elongation and/or crosslinking reaction for forming a modified polyester is not sufficiently performed, resulting in giving adverse effects to the hot offset resistance. Whereas when it is lower than 1.0 (KOHmg/g), the basic compound cannot contribute to maintaining of a stable dispersion state during production. In addition, elongation and/or crosslinking reaction for forming a modified polyester proceeds to an undesired extent, leading to degradation of production stability. Needless to say, both cases are not preferred.

(Measurement Method for Acid Value)

The acid value is measured according to JIS K0070-1992 as follows.

Sample preparation: polyester (0.5 g) is added to THF (120 mL), followed by dissolving under stirring at room temperature (23° C.) for about 10 hours; and ethanol (30 mL) is added to the resultant solution The acid value is calculated in the below-listed measuring apparatus, and specifically, it is obtained as follows.

The sample solution is titrated with a pre-standardized N/10 potassium hydroxide alcohol solution and then the acid value is calculated from the amount of the potassium hydroxide alcohol solution consumed using the following equation, $$\text{Acid value}=\text{KOH (mL)}\times N\times 56.1/\text{mass of sample}$$

where N is a factor of N/10 KOH.

For example, the acid value of a polyester resin, which is preferably used as a resin contained in the toner used in the present invention, is measured according to JIS K0070. The measurement conditions for the acid value are given below. Note that the solvent used is THF.

Measuring apparatus: Potentiometric Automatic Titrator DL-53 (product of Mettler-Toledo K.K.)

Electrode: DG113-SC (product of Mettler-Toledo K.K.)

Analysis software: LabX Light Version 1.00.000

Calibration: solvent mixture of toluene (120 mL) and ethanol (30 mL) is used

Measuring temperature: 23° C.

The setting conditions are as follows.

Stir
- Speed [%] 25
- Time [s] 15

EQP titration
- Titrant/Sensor
- Titrant CH3ONa
- Concentration [mol/L] 0.1
- Sensor DG115
- Unit of measurement mV
- Predispensing to volume
- Volume [mL] 1.0
- Wait time [s] 0
- Titrant addition Dynamic
- dE(set) [mV] 8.0
- dV(min) [mL] 0.03
- dV(max) [mL] 0.5
- Measure mode Equilibrium controlled
- dE [mV] 0.5
- dt [s] 1.0
- t(min) [s] 2.0
- t(max) [s] 20.0
- Recognition
- Threshold 100.0
- Steepest jump only No
- Range No
- Tendency None
- Termination
- at maximum volume [mL] 10.0
- at potential No
- at slope No
- after number EQPs Yes
- n=1
- comb. termination conditions No
- Evaluation
- Procedure Standard
- Potential 1 No
- Potential 2 No
- Stop for reevaluation No In the present invention, the heat resistance during storage of the modified polyester resin (i.e., a main component of the binder resin) depends on the glass transition temperature of a polyester resin before modification and therefore, the glass transition temperature thereof is preferably adjusted to 35° C. to 65° C. When it is lower than 35° C., the heat resistance during storage degrades; whereas when it is higher than 65° C., the low temperature fixing property degrades.

In the present invention, the glass transition temperature is measured with Rigaku THRMOFLEX TG8110 (product of Rigaku Co.) at a temperature increasing rate of 10° C./min.

The procedure performed for measuring the Tg will be roughly described. The apparatus used was a TG-DSC system (TAS-100, product of Rigaku Co.).

Firstly, a sample (about 10 mg) is charged into a sample container made of aluminum; the sample container is placed on a holder unit; and the holder unit is set in an electric furnace. Subsequently, for DSC measuring the sample is heated from room temperature to 150° C, at a temperature increasing rate of 10° C./min; it is left to stand at 150° C. for 10 min; it is cooled to room temperature; it is left to stand for 10 min; and it is heated again to 150° C. at a temperature increasing rate of 10° C./min. Using an analysis system of the TAS-100, the Tg is determined based on a contact point between the baseline and a tangent of the endothermic curve in the vicinity of the Tg.

From the studies performed by the present inventors, a prepolymer used for modifying a polyester resin is important, as a component of the binder resin, for achieving low-temperature fixing property and hot offset resistance. The weight average molecular weight of the prepolymer is preferably 3,000 to 20,000. When it is lower than 3,000, the reaction rate is difficult to control, leading to degradation of production stability. Whereas when it is higher than 20,000, a modified polyester cannot be produced in a sufficient amount, giving adverse effects to the offset resistance.

Furthermore, the present inventors have found that the acid value of the toner is a factor more important than that of the binder resin in terms of improving the low-temperature fixing property and hot offset resistance. The acid value of the toner used in the present invention reflects a terminal carboxyl group of the unmodified polyester. The acid value of the unmodified polyester is preferably adjusted to 0.5 (mgKOH/g) to 40.0 (mgKOH/g) from the viewpoint of controlling the low-temperature fixing property (lower limit of the fixing temperature, the temperature at which hot offset occurs). When it is more than 40.0 (mgKOH/g), elongation reaction or crosslinking reaction for forming a modified polyester does not sufficiently proceeds, giving adverse effects to the hot offset resistance; whereas when it is less than 0.5 (mgKOH/g), the basic compound cannot contribute to maintaining of a stable dispersion state during production. Thus, elongation and/or crosslinking reaction for forming a modified polyester proceeds to an undesired extent, leading to degradation of production stability.

The acid value of the toner is measured in a manner similar to that employed in the measurement of that of the polyester resin (described above).

When THF insoluble matter exists, the acid value of the toner is an acid value measured using THF as a solvent.

(Measuring Method for Acid Value of Toner)

The acid value of the toner is measured according to JIS K0070-1992 under the following conditions.

Sample preparation: the sample preparation performed in the measurement of the acid value of the polyester was repeated, except that the polyester was changed to toner (0.5 g) (ethyl acetate soluble matter: 0.3 g).

The glass transition temperature of the toner used in the developer of the present invention is preferably 40° C. to 70° C. from the viewpoints of attaining desired low-temperature fixing property, excellent heat resistance during storage and high durability. When it is lower than 40° C., blocking in a developing device or filming on an image bearing member (photoconductor) tends to occur; whereas when it is higher than 70° C., low-temperature fixing property tends to degrade.

The toner used in the developer of the present invention is lo produced as follows. Specifically, toner components including at least a colorant and a binder resin formed of a modified polyester resin reactive to an active hydrogen are dissolved/dispersed in an organic solvent to form a solution/dispersion; the formed solution/dispersion is reacted with a crosslinking agent and/or elongating agent in an aqueous medium containing a dispersant; and the solvent is removed from the obtained dispersion.

Examples of the reactive modified polyester resin (RMPE) used in the present invention, which is reactive to an active hydrogen, include an isocyanate group-containing polyester prepolymer (A). For example, the prepolymer (A) is prepared as follows: an active hydrogen-containing polyester is produced through polycondensation between a polyol (PO) and a polycarboxylic acid (PC) and then the thus-produced polyester is reacted with a polyisocyanate (PiC).

Examples of the active hydrogen-containing group contained in the polyester include a hydroxyl group (an alcoholic hydroxyl group and a phenolic hydroxyl group), an amino group, a carboxyl group, a mercapto group, with an alcoholic hydroxyl group being preferred.

The crosslinking agent for the reactive modified polyester resin may be an amine. The elongating agent therefor may be a diisocyanate compound such as diphenylmethane diisocyanate. The amine, which is described below in detail, acts as a crosslinking agent and/or elongating agent for a modified polyester reactive to an active hydrogen.

The modified polyester (e.g., urea-modified polyester), which is prepared by reacting the isocyanate group-containing polyester prepolymer (A) with the amine (B), is easily adjusted for the molecular weight of the polymer component thereof and thus is preferably used for forming dry toner, in particular for assuring oil-less low temperature fixing property (e.g., releasing and fixing properties requiring no releasing oil-application mechanism for a heat-fixing medium). In particular, a urea-modified polyester prepolymer can prevent the formed toner from adhering to the heat-fixing medium, while maintaining high fluidity and transparency of the unmodified polyester resin at a fixing temperature thereof.

The polyester prepolymer preferably used in the present invention is prepared by introducing, to a polyester having at its end an acid group or hydroxyl group containing an active hydrogen, a functional group reactive to the active hydrogen (e.g., isocyanate group). A modified polyester (MPE) (e.g., urea-modified polyester) can be directly derived from the thus-obtained prepolymer. In the present invention, however, this isocyanate group-containing polyester prepolymer (A) is reacted with the amine (B) serving as a crosslinking agent and/or elongating agent to produce a urea-modified polyester, which is preferably used as a binder resin.

The isocyanate group-containing polyester prepolymer (A) can be produced as follows: a polyester having an active hydrogen-containing group is produced through polycondensation between a polyol (PO) and a polycarboxylic acid (PC) and then the thus-produced polyester is reacted with a polyisocyanate (PiC).

Examples of the active hydrogen-containing group contained in the polyester include a hydroxyl group (an alcoholic hydroxyl group and a phenolic hydroxyl group), an amino group, a carboxyl group, a mercapto group, with an alcoholic hydroxyl group being preferred.

Examples of the polyol (PO) include diols (DIOs) and polyols with 3 or more hydroxyl groups (TOs). Preferably, a DIO is used alone or as a mixture with a small amount of a TO.

Examples of the DIO include alkylene glycols (e.g., ethylene glycol, 1,2-propylene glycol, 1,3-propylene glycol, 1,4-butanediol and 1,6-hexanediol); alkylene ether glycols (e.g., diethylene glycol, triethylene glycol, dipropylene glycol, polyethylene glycol, polypropylene glycol and polytetramethylene ether glycol); alicyclic diols (e.g., 1,4-cyclohexane dimethanol and hydrogenated bisphenol A); bisphenols (e.g., bisphenol A, bisphenol F and bisphenol S); adducts of the above-listed alicyclic diols with alkylene oxides (e.g., ethylene oxide, propylene oxide and butylene oxide); and adducts of the above-listed bisphenols with alkylene oxides (e.g., ethylene oxide, propylene oxide and butylene oxide).

Of these, preferred are alkylene glycols having 2 to 12 carbon atoms and adducts of bisphenols with alkylene oxides, with the latter being particularly preferred. In addition, these are particularly preferably used in combination. Examples of the TO include polyvalent aliphatic alcohols with 3 or more hydroxyl groups (e.g., glycerin, trimethylolethane, trimethylolpropane, pentaerythritol and sorbitol); phenols with 3 or more hydroxyl groups (e.g., trisphenol PA, phenol novolak and cresol novolak); and adducts of alkylene oxides with the above-listed phenols having 3 or more hydroxyl groups.

Examples of the polycarboxylic acid (PC) include dicarboxylic acids (DICs) and polycarboxylic acids with 3 or more carboxylic groups (TCs). Preferably, a DIC is used alone or as a mixture with a small amount of a TC.

Examples of the DIC include alkylene dicarboxylic acids (e.g., succinic acid, adipic acid and sebacic acid); alkenylene dicarboxylic acids (e.g., maleic acid and fumaric acid); and aromatic dicarboxylic acids (e.g., phthalic acid, isophthalic acid, terephthalic acid and naphthalene dicarboxylic acid). Of these, preferred are alkenylene dicarboxylic acids having 4 to 20 carbon atoms and aromatic dicarboxylic acids having 8 to 20 carbon atoms.

Examples of the TC include aromatic polycarboxylic acids having 9 to 20 carbon atoms (e.g., trimellitic acid and pyromellitic acid).

Also, the above PCs may be reacted with POs in the form of anhydrides thereof or lower alkyl esters thereof (e.g., methyl esters, ethyl esters and isopropyl esters). The ratio of PO to PC is generally 2/1 to 1/1, preferably 1.5/1 to 1/1, more preferably 1.3/1 to 1.02/1, in terms of the equivalent ratio [OH]/[COOH] of hydroxyl group [OH] to carboxylic group [COOH].

Examples of the PIC include aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate);

aromatic diisocyanates (e.g., tolylene diisocyanate and diphenylmethane diisocyanate); aroma-aliphatic diisocyanates (e.g., a, α, α', α'-tetramethylxylylene diisocyanate); and isocyanurates. In addition, there can be used products obtained by blocking the above-listed polyisocyanates with a phenol derivative, oxime or caprolactam. Furthermore, these compounds may be used in combination.

The ratio of PIC to hydroxyl group-containing polyester is generally 5/1 to 1/1, preferably 4/1 to 1.2/1, more preferably 2.5/1 to 1.5/1, in terms of the equivalent ratio [NCO]/[OH] of isocyanate group [NCO] to hydroxyl group [OH].

When the equivalent ratio [NCO]/[OH] is greater than 5, low-temperature fixing property degrades. When the relative [NCO] with respect to [OH] is less than 1, the urea content of the modified polyester decreases and hot offset resistance degrades.

The amount of a polyisocyanate (3) (constitutional component) contained in the polyester prepolymer (A) having a polyisocyanate group at its end is generally 0.5% by mass to 40% by mass, preferably 1% by mass to 30% by mass, more preferably 2% by mass to 20% by mass. When the amount is less than 0.5% by mass, hot offset resistance degrades. In addition, desired heat resistance during storage and desired low-temperature fixing property are not difficult to attain at the same time. Meanwhile, when the amount is greater than 40% by mass, low-temperature fixing property degrades.

The polyester prepolymer (A) generally has, in one molecule thereof, one or more isocyanate groups, preferably 1.5 groups to 3 groups on average, more preferably 1.8 groups to 2.5 groups on average. When the number of the isocyanate group is less than one per one molecule, the molecular weight of the urea-modified polyester decreases and hot offset resistance degrades.

Examples of the amine (B) include diamines (B1), tri- or more-valent amines (B2), amino alcohols (B3), aminomercaptans (B4), amino acids (B5), and amino-blocked products (B6) of the amines (B1) to (B5).

Examples of the diamine (B1) include aromatic diamines (e.g., phenylenediamine, diethyltoluenediamine and 4,4'-diaminodiphenylmethane); alicyclic diamines (e.g., 4,4'-diamino-3,3'-dimethyldicyclohexylmethane, diaminocyclohexane, isophoronediamine); and aliphatic diamines (e.g., ethylenediamine, tetramethylenediamine and hexamethylenediamine). Examples of the tri- or more-valent amine (B2) include diethylenetriamine and triethylenetetramine. Examples of the amino alcohol (B3) include ethanolamine and hydroxyethylaniline. Examples of the aminomercaptan (B4) include aminoethyl mercaptan and aminopropyl mercaptan. Examples of the amino acid (B5) include aminopropionic acid and aminocaproic acid. Examples of the amino-blocked product (B6) include ketimine compounds and oxazolidine compounds derived from the amines (B1) to (B5) and ketones (e.g., acetone, methyl ethyl ketone and methyl isobutyl ketone). Among these amines (B), the diamine (B1) is particularly preferred. Also, particularly preferred is a mixture of the diamine (B1) and a small amount of the tri- or more-valent amine (B2).

If necessary, the molecular weight of the urea-modified polyester can be controlled using an elongation terminater. Examples of the elongation terminater include monoamines (e.g., diethyl amine, dibutyl amine, butyl amine and lauryl amine) and blocked products thereof (e.g., ketimine compounds).

The ratio of isocyanate group-containing prepolymer (A) to amine (B) is generally 1/2 to 2/1, preferably 1.5/1 to 1/1.5, more preferably 1.2/1 to 1/1.2, in terms of the equivalent ratio [NCO]/[NHx] of isocyanate group [NCO] to amino group [NHx]. When the ratio [NCO]/[NHx] is greater than 2 or less than 1/2, the molecular weight of the formed urea-modified polyester decreases, resulting in degradation of hot offset resistance.

The urea-modified polyester (UMPE), which is a polyester (resin) preferably used in the present invention, may contain not only a urea bond but also a urethane bond. The ratio by mole of urea bond to urethane bond is generally 100/0 to 10/90, preferably 80/20 to 20/80, more preferably 60/40 to 30/70. When the relative [urea bond] with respect to [urethane bond] is less than 10%, hot offset resistance degrades.

The modified polyester (e.g., UMPE) is produced with, for example, the one-shot method. The weight-average molecular weight of the modified polyester (e.g., UMPE) is generally 10,000 or more, preferably 20,000 to 10,000,000, still more preferably 30,000 to 1,000,000. When the weight-average molecular weight is less than 10,000, hot offset resistance degrades. The number-average molecular weight of the modified polyester (e.g., UMPE) is not particularly limited when an unmodified polyester (PE) described below is used in combination, and may be a value at which the modified polyester having a weight-average molecular weight falling within the above range can be easily obtained. When the UMPE is used alone, the number-average molecular weight thereof is 2,000 to 15,000, preferably 2,000 to 10,000, more preferably 2,000 to 8,000. When it is greater than 15,000, the low-temperature fixing property degrades. In addition, the glossiness of the image obtained using a full-color image forming apparatus degrades.

In the present invention, the modified polyester (e.g., UMPE) may be used alone or in combination with an unmodified polyester (PE) serving as one component of the binder resin. Use of the modified polyester in combination with the unmodified polyester (PE) is preferred, since the low-temperature fixing property is improved and the glossiness of the image obtained using a full-color image forming apparatus increases.

Examples of the PE include polycondensates between the polyols (POs) and the polycarboxylic acids (PCs) which are listed in relation to synthesis of the UMPE. Also, preferred POs and PCs are the same as listed in relation to synthesis of the UMPE.

The PE has a weight-average molecular weight (Mw) of 10,000 to 300,000, preferably 14,000 to 200,000 and has a number-average molecular weight of 1,000 to 10,000, preferably 1,500 to 6,000. Also, in combination with the UMPE, not only the unmodified polyester but also other modified polyesters than urea-modified polyesters (e.g., urethane-modified polyesters) can be used. Preferably, the UMPE and the PE are at least partially mixed with/dissolved in each other from the viewpoints of attaining improved low-temperature fixing property and improved hot offset resistance. Thus, preferably, the polyester components forming the UMPE are similar to those forming the PE.

The ratio by mass of UMPE and PE is generally 5/95 to 80/20, preferably 5/95 to 30/70, more preferably 5/95 to 25/75, still more preferably 7/93 to 20/80. When the relative UMPE amount is less than 5%, the hot offset resistance degrades. In addition, desired heat resistance during storage and desired low-temperature fixing property are not difficult to attain at the same time.

The PE preferably has a hydroxyl value of 5 mgKOH/g or more. Also, it generally has an acid value of 1 mgKOH/g to 30 mgKOH/g, preferably 5 mgKOH/g to 20 mgKOH/g. The toner containing the PE having an acid value of 1 mgKOH/g or more tends to be negatively chargeable, exhibits excellent affinity to paper during fixation, and exhibits improved low-temperature fixing property. When the acid value is greater than 30 mgKOH/g, the chargeability tends to be adversely affected by changing environmental factors; i.e., the reliable chargeability cannot be obtained. Also, a change in the acid value during polymerization reaction causes an unstable granulation process, making it difficult to attain a controlled emulsified state.

(Measuring Method for Hydroxyl Value)

The measurement conditions of the apparatus are set to those given in relation to the measurement of an acid value.

A sample of 0.5 g is precisely weighed and placed in a 100 mL-measuring flask. An acetylating reagent (5 mL) is precisely added to the flask, followed by heating in a hot-water bath at 100° C±5° C. One to two hours after, the flask is removed from the bath and is left to cool in air, followed by addition of water. The flask is swung to decompose an acetic anhydride. In order for the acetic anhydride to thoroughly decompose, the flask is placed again in the bath and heated for 10 min or longer, followed by cooling in air. Subsequently, the wall of the flask is washed with an organic solvent. The resultant liquid is subjected to potentiometric titration using the above electrode and an N/2 solution of potassium hydroxide in ethyl alcohol, to thereby determine an OH value of the sample (according to JIS K0070-1966).

In the present invention, the binder resin generally has a glass transition temperature (Tg) of 40° C. to 70° C., preferably 40° C. to 60° C. When the Tg is lower than 40° C., the formed toner exhibits degraded heat resistance; whereas when the Tg is higher than 70° C., the formed toner exhibits insufficient low-temperature fixing property. Even in use of a binder resin with low Tg, if this binder resin is used in combination with the modified polyester (e.g., UMPE), the formed toner, which is used in the present invention, tends to exhibit excellent heat resistance during storage.

(Releasing Agent)

A releasing agent (wax) used in the toner of the present invention preferably has a low melting point-a melting point of 50° C. to 120° C. Such a wax effectively acts on the interface between a fixing roller and toner particles in a state where it is dispersed together with a binder resin. As a result, without applying an oil or other releasing agent onto the fixing roller, the hot offset resistance can be improved.

Notably, in the present invention, the melting point of the wax is a maximum endothermic peak determined with a differential scanning calorimeter (DSC).

In the present invention, the following materials can be used as a wax component serving as a releasing agent.

Specific examples thereof include natural waxes such as vegetable waxes (e.g., carnauba wax, cotton wax, Japan wax and rice wax), animal waxes (e.g., bees wax and lanolin), mineral waxes (e.g., ozokelite and ceresine) and petroleum waxes (e.g., paraffin waxes, microcrystalline waxes and petrolatum); synthetic hydrocarbon waxes (e.g., Fischer-Tropsch waxes and polyethylene waxes); and synthetic waxes (e.g., ester waxes, ketone waxes and ether waxes). Further examples include fatty acid amides such as 12-hydroxystearic acid amide, stearic acid amide, phthalic anhydride imide and chlorinated hydrocarbons; and crystalline polymers having, as a side chain, a long alkyl group such as acrylic homopolymers and acrylic copolymers (e.g., poly-n-stearyl methacrylate, poly-n-laurylmethacrylate and n-stearyl acrylate-ethyl methacrylate copolymers, these being a low-molecular-weight crystalline polymer resin).

(Colorant)

The colorant for use in the toner contained in the developer of the present invention may be any dye and pigment known in the art. Examples thereof include carbon black, nigrosine dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazinelake, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro anilin red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red F5R, brilliant carmin 6B, pigment scarlet 3B, bordeaux 5B, toluidine Maroon, permanent bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanin blue, phthalocyanin blue, fast sky blue, indanthrene blue (RS and BC), indigo, ultramarine, iron blue, anthraquinon blue, fast violet B, methylviolet lake, cobalt purple, manganese violet, dioxane violet, anthraquinon violet, chrome green, zinc green, chromium oxide, viridian, emerald green, pigment green B, naphthol green B, green gold, acid green lake, malachite green lake, phthalocyanine green, anthraquinon green, titanium oxide, zinc flower, lithopone and mixtures thereof. The colorant content is generally 1% by mass to 15% by mass, preferably 3% by mass to 10% by mass, with respect to the toner.

In the present invention, the colorant may be mixed with a resin to form a masterbatch.

Examples of the binder resin which is used for producing a masterbatch or which is kneaded together with a masterbatch include the above-described modified or unmodified polyester resins; styrene polymers and substituted products thereof (e.g., polystyrenes, poly-p-chlorostyrenes and polyvinyltoluenes); styrene copolymers (e.g., styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloro methacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, styrene-maleic acid ester copolymers); polymethyl methacrylates; polybutyl methacrylates; polyvinyl chlorides; polyvinyl acetates; polyethylenes; polypropylenes, polyesters; epoxy resins; epoxy polyol resins; polyurethanes; polyamides; polyvinyl butyrals; polyacrylic acid resins; rosin; modified rosin; terpene resins; aliphatic or alicyclic hydrocarbon resins; aromatic petroleum resins; chlorinated paraffins; and paraffin waxes. These may be used alone or in combination.

The masterbatch can be prepared by mixing/kneading a colorant with a resin for use in a masterbatch through application of high shearing force. Also, an organic solvent may be used for improving mixing between these materials. Further, the flashing method, in which an aqueous paste containing a colorant is mixed/kneaded with a resin and an organic solvent and then the colorant is transferred to the resin to remove water and the organic solvent, is preferably used, since a wet cake of the colorant can be directly used (i.e., no drying is required to be performed). In this mixing/kneading, a high-shearing disperser (e.g., three-roll mill) is preferably used.

In a known production method for electrophotographic toner, particles containing a colorant and a resin are mixed with charge controlling agent-containing particles in a container using a rotating member, to thereby fix the charge controlling agent on the surface of the toner particles. In the present invention, the toner particles can be produced with this method which uses a container whose inner wall has no fixed member protruding therefrom and in which the rotating member is rotated at a rotating speed of 40 m/sec to 150 m/sec for mixing.

If necessary, the toner used in the present invention may contain a charge controlling agent.

The charge controlling agent may be appropriately selected from those known in the art. Examples thereof include nigrosine dyes, triphenylmethane dyes, chrome-containing metal complex dyes, molybdenum acid chelate pigments, rhodamine dyes, alkoxy amines, quaternary ammonium salts (including fluorine-modified quaternary ammonium salts), alkylamides, phosphorus, phosphorus compounds, tungsten, tungsten compounds, fluorine-based active agents, metal salts of salicylic acid, and metal salts of salicylic acid derivatives. Specific examples thereof include BONTRON 03 (nigrosine dye), BONTRON P-51 (quaternary ammonium salt), BONTRON S-34 (metal azo-containing dye), E-82 (oxynaphthoic acid-based metal complex), E-84 (salicylic acid-based metal complex) and E-89 (phenol condensate) (these products are of Orient Chemical Industries, Ltd.); TP-302 and TP-415 (quaternary ammonium salt molybdenum complex (these products are of Hodogaya Chemical Co.); COPY CHARGE PSY VP 2038 (quaternary ammonium salt), COPY BLUE PR (triphenylmethane derivative), COPY CHARGE NEG VP2036 (quaternary ammonium salt) and COPY CHARGE NX VP434 (these products are of Hoechst AG); LRA-901 and LR-147 (boron complex) (these products are of Japan Carlit Co., Ltd.); copper phthalocyanine; perylene; quinacridone; azo pigments; and polymeric compounds having, as a functional group, a sulfonic acid group, carboxyl group, quaternary ammonium salt, etc.

In the present invention, the charge controlling agent content is not determined depending on a single factor and is varied depending on the type of the binder resin used, on an optionally used additive, and on the toner production method used (including the dispersion method used). The charge controlling agent content is preferably 0.1 parts by mass to 10 parts by mass, more preferably 0.2 parts by mass to 5 parts by mass, per 100 parts by mass of the binder resin. When the content is more than 10 parts by mass, the formed toner has too high chargeability, resulting in that the charge controlling agent exhibits reduced effects. As a result, the electrostatic force increases between the developing roller and the toner, decreasing the fluidity of the toner and forming an image with reduced color density. These charge controlling agent and release agent may be melt-kneaded together with a masterbatch or resin. Alternatively, they may be added at the time when other toner components are dissolved or dispersed in an organic solvent.

In the present invention, an external additive may be added to the toner for improving color particles in fluidity, developability and chargeability, and inorganic microparticles are preferably used as the external additive.

The inorganic microparticles preferably have a primary particle diameter of 5 mμ to 2 mμ, particularly preferably 5 mμ to 500 mμ. Also, the specific surface area thereof as measured with the BET method is preferably 20 $m^2/g$ to 500 $m^2/g$. The amount of the inorganic microparticles used is preferably 0.01% by mass to 5% by mass, particularly preferably 0.01% by mass to 2.0% by mass.

Specific examples of such inorganic microparticles include silica, alumina, titanium oxide, barium titanate, magnesium titanate, calcium titanate, strontium titanate, zinc oxide, tin oxide, silica sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide and silicon nitride.

As a fluidity-imparting agent, there is preferably used a mixture of hydrophobic silica microparticles and hydrophobic titanium oxide microparticles. In particular, when these microparticles each having an average particle diameter of 50 mμ or smaller are stirred/mixed and then used, the electrostatic force and van der Waals' force are considerably improved between the thus-treated microparticles and the toner particles. Thus, even when these are stirred/mixed in the developing unit for attaining a desired charge level, the fluidity-imparting agent is lost from the toner, resulting in forming a high-quality image without white spots, etc. and reducing the amount of toner remaining after transfer.

Although titanium oxide microparticles are excellent in terms of environmental stability and forming images having a constant density, the formed toner exhibits degraded charge rising property. Thus, when the amount of titanium oxide microparticles is larger than that of silica microparticles, the adverse side effects thereof are thought to be considerably exhibited. When hydrophobic silica oxide microparticles and hydrophobic titanium microparticles are added in a total amount of 0.3% by mass to 1.5% by mass, the charge rising property of the formed toner does not considerably degrades; i.e., the formed toner exhibits desired charge rising property. That is, even when repeatedly used in printing, the toner can consistently form images having a certain quality and avoid toner scattering.

The binder resin can be produced with, for example, the following method.

Specifically, a polyol (PO) and a polycarboxylic acid (PC) are heated to a temperature of 150° C. to 280° C. in the presence of a known esterification catalyst such as tetrabutoxy titanate and dibutyltin oxide. Subsequently, the formed water is removed (if necessary, this water removal is performed under reduced pressure) to prepare a polyester having a hydroxyl group. Thereafter, the thus-prepared polyester is reacted with a polyisocyanate (PIC) at a temperature of 40° C. to 140° C. to prepare a polyester prepolymer (A) having an isocyanate group. Further, the thus-prepared polyester prepolymer (A) is reacted with an amine (B) at a temperature of 0° C. to 140° C. to prepare a urea-modified polyester (UMPE).

This modified polyester preferably has a number average molecular weight of 1,000 to 10,000, more preferably 1,500 to 6,000.

If necessary, a solvent may be used in the reactions between (A) and (B) and between the hydroxyl group-containing polyester and the PIC.

Examples of the solvent include those inert with respect to a PIC. Specific examples thereof include aromatic solvents (e.g., toluene and xylene), ketones (e.g., acetone, methyl ethyl ketone and methyl isobutyl ketone), esters (e.g., ethyl acetate), amides (e.g., dimethylformamide and dimethylacetamide) and ethers (e.g., tetrahydrofuran). In the case where an unmodified polyester (PE) is used in combination, the PE is produced in a manner similar to that performed in the above production for a hydroxyl group-containing polyester, and then the formed PE is dissolved in and mixed with the solution obtained after completion of UMPE production.

The toner used in the present invention can be produced with the following method. Needless to say, the production method is not limited thereto.

(Production Method for Toner in Aqueous Medium)

An aqueous medium used in the present invention may be water itself or a mixture of water and a water-miscible solvent. Examples of the water-miscible solvent include alcohols (e.g., methanol, isopropanol and ethylene glycol), dimethylformamide, tetrahydrofuran, cellosolves (e.g., methyl cellosolve) and lower ketones (e.g., acetone and methyl ethyl ketone).

In the present invention, the reactive modified polyester (e.g., isocyanate group-containing polyester prepolymer (A)) is reacted with the amine (B) in the aqueous medium to form a urea-modified polyester (UMPE). These modified polyester (e.g., urea-modified polyester) and reactive modified polyester (raw materials for toner) can be stably dispersed in an aqueous medium through application of shearing force, etc. The reactive modified polyester (e.g., prepolymer (A)) may be mixed with other toner components (hereinafter referred to as "toner raw materials") (e.g., a colorant, a colorant masterbatch, a releasing agent, a charge controlling agent and an unmodified polyester resin) through dispersion in an aqueous medium. Preferably, toner raw materials are previously mixed one another and then the resultant mixture is dispersed in an aqueous medium. Also, in the present invention, a colorant, a releasing agent, a charge controlling agent, etc. (i.e., other toner raw materials) may be added to an aqueous medium before or after particle formation. For example, after particles containing no colorant are formed, a colorant may be added to the obtained particles with a known dying method.

The dispersion method is not particularly limited. There can be used known dispersers employing, for example, low-speed shearing, high-speed shearing, friction, high-pressure jetting and ultrasonic wave. In order for the dispersoid to have a particle diameter of 2 μm to 20 μm, a high-speed shearing disperser is preferably used. In use of the high-speed shearing disperser, the rotating speed is not particularly limited and is generally 1,000 rpm to 30,000 rpm, preferably 5,000 rpm to 20,000 rpm. Also, the dispersion time is not particularly limited and is generally 0.1 min to 5 min when a batch method is employed. The temperature during dispersion is generally 0° C. to 150° C. (in a pressurized state), preferably from 40° C. to 98° C. The temperature is preferably higher, since the dispersoid formed of UMPE and/or prepolymer (A) has a lower viscosity and thus can be readily dispersed.

The amount of the aqueous medium used is generally 50 parts by mass to 2,000 parts by mass, preferably 100 parts by mass to 1,000 parts by mass, per 100 parts by mass of the toner components including a urea-modified polyester and/or polyester (e.g., prepolymer (A)). When the amount is less than 50 parts by mass, the toner composition cannot be sufficiently dispersed, resulting in failure to form toner particles having a predetermined particle diameter. Meanwhile, use of the aqueous medium more than 2,000 parts by mass is economically disadvantageous. If necessary, a dispersant may be used. Use of the dispersant is preferred from the viewpoints of attaining a sharp particle size distribution and realizing a stable dispersion state.

An oil phase containing the toner composition in a dispersed state is emulsified or dispersed in an aqueous liquid using various dispersants. Examples of the dispersant include surfactants, inorganic microparticles and polymer microparticles.

Examples of the surfactant include anionic surfactants such as alkylbenzenesulfonic acid salts, α-olefin sulfonic acid salts and phosphoric acid esters; cationic surfactants such as amine salts (e.g., alkyl amine salts, aminoalcohol fatty acid derivatives, polyamine fatty acid derivatives and imidazoline), and quaternary ammonium salts (e.g., alkyltrimethylammonium salts, dialkyl dimethylammonium salts, alkyl dimethyl benzyl ammonium salts, pyridinium salts, alkyl isoquinolinium salts and benzethonium chloride); nonionic surfactants such as fatty acid amide derivatives and polyhydric alcohol derivatives; and amphoteric surfactants such as alanine, dodecyl-di(aminoethyl)-glycine, di(octylaminoethyl)-glycine and N-alkyl-N,N-dimethylammonium betaine.

Also, a fluoroalkyl group-containing surfactant can provide, even in a small amount, a dispersion having a desired dispersion state. Among others, a fluoroalkyl group-containing anionic surfactant is preferably used. Examples thereof include fluoroalkyl carboxylic acids having 2 to 10 carbon atoms and metal salts thereof, disodium perfluorooctane sulfonylglutamate, sodium 3-[omega-fluoroalkyl(C6 to C11) oxy)-1-alkyl(C3 or C4) sulfonates, sodium 3-[omega-fluoroalkanoyl(C6 to C8)-N-ethylamino]-1-propanesulfonates, fluoroalkyl(C11 to C20) carboxylic acids and metal salts thereof, perfluoroalkylcarboxylic acids(C7 to C13) and metal salts thereof, perfluoroalkyl(C4 to C12)sulfonate and metal salts thereof, perfluorooctanesulfonic acid diethanol amide, N-propyl-N-(2-hydroxyethyl)perfluorooctanesulfone amide, perfluoroalkyl(C6 to C10)sulfoneamidepropyltrimethylammonium salts, salts of perfluoroalkyl(C6 to C10)-N-ethylsulfonylglycin and monoperfluoroalkyl(C6 to C16) ethylphosphates.

Examples of commercially available products of the above-listed anionic surfactants include SURFLON S-111, S-112 and S-113 (these products are of Asahi Glass Co., Ltd.); FRORARD FC-93, FC-95, FC-98 and FC-129 (these products are of Sumitomo 3M Ltd.); UNIDYNE DS-101 and DS-102 (these products are of Daikin Industries, Ltd.); MEGAFACE F-110, F-120, F-113, F-191, F-812 and F-833 (the se products are of Dainippon Ink and Chemicals, Inc.); ECTOP EF-102, 103, 104, 105, 112, 123A, 123B, 306A, 501, 201 and 204 (these products are of Tohchem Products Co., Ltd.); and FUTARGENT F-100 and F150 (these products are of NEOS COMPANY LIMITED).

In addition, a fluoroalkyl group-containing cationic surfactant may be used. Examples thereof include fluoroalkyl group-containing primary/secondary aliphatic compounds, fluoroalkyl group-containing secondary amine acids, aliphatic quaternary ammonium salts (e.g., perfluoroalkyl(C6 to C10)sulfoneamide propyltrimethylammonium salts), benzalkonium salts, benzetonium chloride, pyridinium salts and imidazolinium salts.

Examples of commercially available products of the above-listed cationic surfactants include SURFLON S-121 (product of Asahi Glass Co., Ltd.); FRORARD FC-135 (product of Sumitomo 3M Ltd.); UNIDYNE DS-202 (product of Daikin Industries, Ltd.); MEGAFACE F-150 and F-824 (these products are of Dainippon Ink and Chemicals, Inc.); ECTOP EF-132 (product of Tohchem Products Co., Ltd.); and FUTARGENT F-300 (product of Neos COMPANY LIMITED).

In addition, there can be used tricalcium phosphate, calcium carbonate, titanium oxide, colloidal silica, hydroxyapatite, and other poorly water-soluble inorganic dispersants.

In addition, polymer microparticles can be effectively used as a dispersant similar to the above inorganic dispersant. Examples thereof include MMA polymer microparticles with a particle diameter of 1 μm or 3 μm; styrene microparticles with a particle diameter of 0.5 μm or 2 μm; and styrene-acrylonitrile microparticles with a particle diameter of 1 μm (e.g., PB-200H (product of Kao Corp.), SGP (product of Soken Chemical & Engineering Co., Ltd.), TECHNOPOLYMER SB (product of Sekisui Plastics Co., Ltd.), SGP-3G (product of Soken Chemical & Engineering Co., Ltd.) and MICROPEARL (product of Sekisui Fine Chemical Co., Ltd.)).

Further, a polymeric protective colloid may be used in combination with the above inorganic dispersants and/or polymer microparticles to stably disperse toner components. Examples of the polymeric protective colloid include polymers and copolymers prepared using acids (e.g., acrylic acid, methacrylic acid, α-cyanoacrylic acid, α-cyanomethacrylic acid, itaconic acid, crotonic acid, fumaric acid, maleic acid and maleic anhydride); hydroxyl group-containing acrylic monomers (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic acid esters, diethylene glycol monomethacrylic acid esters, glycerin monoacrylic acid esters, glycerin monomethacrylic acid esters, N-methylolacrylamide and N-methylolmethacrylamide), vinyl alcohol and ethers thereof (e.g., vinyl methyl ether, vinyl ethyl ether and vinyl propyl ether), esters formed between vinyl alcohol and a carboxyl group-containing compound (e.g., vinyl acetate, vinyl propionate and vinyl butyrate); acrylamide, methacrylamide, diacetoneacrylamide and methylol compounds of these; acid chlorides (e.g., acrylic acid chloride and methacrylic acid chloride); nitrogen-containing compounds and nitrogen-containing heterocyclic compounds (e.g., vinyl pyridine, vinyl pyrrolidone, vinyl imidazole and ethyleneimine); polyoxyethylenes (e.g., polyoxyethylene, polyoxypropylene, polyoxyethylene alkyl amines, polyoxypropylene alkyl amines, polyoxyethylene alkyl amides, polyoxypropylene alkyl amides, polyoxyethylene nonylphenyl ethers, polyoxyethylene laurylphenyl ethers, polyoxyethylene stearylphenyl esters and polyoxyethylene nonylphenyl esters); and celluloses (e.g., methyl cellulose, hydroxyethyl cellulose and hydroxypropyl cellulose).

The obtained emulsion (reaction mixture) is stirred/astringed within a certain temperature range whose upper limit is lower than the glass transition temperature of the resin and within a certain concentration range of the organic solvent to thereby form flocculated particles. Subsequently, the reaction system is gradually increased in temperature under laminar flow stirring, followed by solvent removal, to thereby form deformed toner particles. When an acid (e.g., calcium phosphate) or an alkali-soluble compound is used as a dispersion stabilizer, the calcium phosphate is dissolved with an acid (e.g., hydrochloric acid), followed by washing with water, to thereby remove it from the formed particles. Also, the calcium phosphate can be removed through enzymatic decomposition.

Alternatively, the dispersant used may remain on the surface of the toner particles.

Additionally, a solvent in which UMPE or polyester (e.g., prepolymer (A)) is soluble can be used for decreasing the viscosity of a dispersion medium containing toner components. Use of the solvent is preferred from the viewpoint of attaining a sharp particle size distribution. The solvent used is preferably volatile-has a boiling point lower than 100° C., since solvent removal can be easily performed.

Examples of the solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone and methyl isobutyl ketone. These solvents may be used alone or in combination. Among them, toluene and xylene (i.e., aromatic solvents); and methylene chloride, 1,2-dichloroethane, chloroform and carbon tetrachloride (i.e., halogenated hydrocarbons) are preferred.

The solvent is generally used in an amount of 0 parts by mass to 300 parts by mass, preferably 0 parts by mass to 100 parts by mass, more preferably 25 parts by mass to 70 parts by mass, per 100 parts by mass of the prepolymer (A). The solvent used is removed under normal or reduced pressure from a reaction mixture obtained after completion of elongation and/or crosslinking reaction between the modified polyester (prepolymer) and the amine.

The time required for elongation and/or crosslinking reaction depends, for example, on reactivity between the isocyanate group-containing prepolymer (A) used and the selected amine (B), and is generally 10 min to 40 hours, preferably 2 hours to 24 hours. The reaction temperature is generally 0° C. to 150° C., preferably 40° C. to 98° C. If necessary, a known catalyst may be used. Examples thereof include dibutyltin laurate and dioctyltin laurate. Notably, as described above, the amine (B) serves as an elongating agent and/or crosslinking agent.

In the present invention, preferably, the dispersion (reaction mixture) obtained after elongating and/or crosslinking reaction(s) is stirred/astringed within a certain temperature range whose upper limit is lower than the glass transition temperature of the resin and within a certain concentration range of the organic solvent to thereby form flocculated particles, and the shape of the thus-obtained particles are visually observed, followed by solvent removal at 10° C. to 50° C. When the dispersion is stirred prior to solvent removal, the toner particles contained therein are deformed. Particularly in the present invention, the toner contains an inorganic layered mineral in which at least part of interlayer ions is modified with organic ions, assuring deformation of the toner. The above granulation conditions may be appropriately adjusted depending on the purpose. Notably, when the dispersion (emulsion) has, during granulation, a high concentration of the organic solvent, the viscosity thereof decreases. As a result, when droplets are combined with one another, the formed particles tend to be spherical. Thus, the viscosity must be adjusted appropriately.

Meanwhile, when the dispersion has, during granulation, a low concentration of the organic solvent, the combined droplets are separated from one another since the viscosity thereof is high (i.e., particles cannot be completely formed). Thus, the optimal conditions must be determined, and also the shape of toner can be appropriately adjusted depending on the selected conditions.

In the present invention, furthermore, the shape of toner can be adjusted by changing the amount of the inorganic layered mineral in which at least part of interlayer ions is modified with organic ions (organic-modified inorganic layered mineral). Preferably, the amount of the organic-modified inorganic layered mineral is 0.05% to 10% with respect to the dispersion (or solution) on a solid basis. When the amount is less than 0.05%, the viscosity of the oil phase cannot be adjusted to a desired level, not forming the toner having a desired shape. In addition, the droplets flocculated during stirring/astringing have an undesired shape (i.e., spherical shape) since the viscosity thereof is low. Whereas when the amount is more than 10%, production suitability degrades, the viscosity of the droplets is too high to form flocculated particles, and the formed toner exhibits degraded fixing property.

Also, the ratio Dv/Dn of the toner, wherein Dv and Dn denote a volume average particle diameter and a number average particle diameter, respectively, may be controlled by adjusting, for example, the viscosity of a water/oil phase, and properties and the amount of the resin micorparticles. Further, the Dv and Dn each may be controlled by adjusting, for example, properties and the amount of resin microparticles.

Next will be described a process cartridge, image forming apparatus and image forming method of the present invention.

[Image Forming Apparatus and Process Cartridge]

Figure 4:
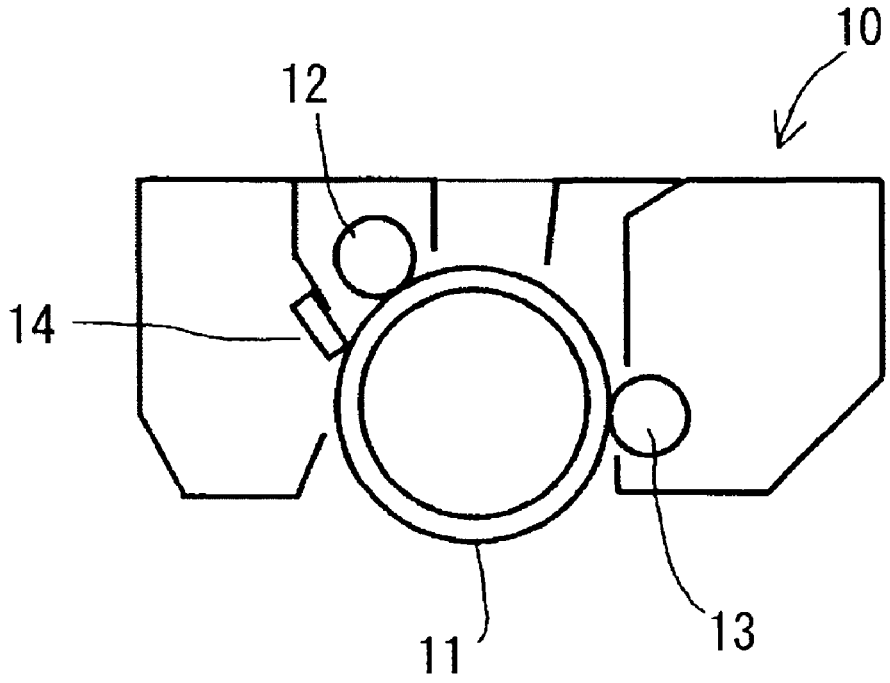
FIG. 4 shows an embodiment of the process cartridge having the electrophotographic developer of the present invention.

FIG. 4 shows an embodiment of the process cartridge containing the electrophotographic developer of the present invention.

As shown in FIG. 4, a process cartridge (10) of the present invention includes a photoconductor (11) serving as an image bearing unit and at least one unit selected from a charging unit (12), a developing unit (13) and a cleaning unit (14), the photoconductor and the at least one unit being integrally supported; and is detachably mounted to an image forming apparatus main body.

Figure 5:
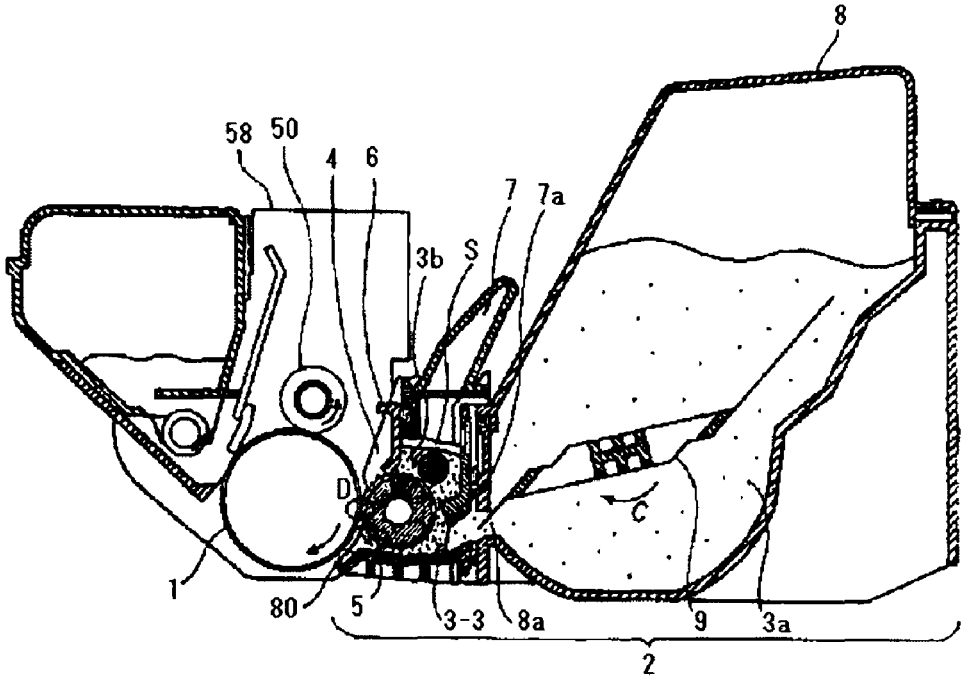
FIG. 5 shows an embodiment of the image forming apparatus having the process cartridge of the present invention.

FIG. 5 shows an embodiment of the image forming apparatus having the process cartridge of the present invention.

The image forming apparatus of the present invention includes at least a photoconductor, a developing unit configured to develop an electrophotographic latent image on the photoconductor with a developer so as to form a visible image, a transfer unit configured to transfer the image onto a recording medium and a fixing unit configured to fix the transferred image on the recording medium. Specifically, this image forming apparatus is formed of an image forming apparatus main body (e.g. a copier and printer) and a process cartridge which is detachably mounted thereto and which includes, in the form of one piece, a developing unit using the developer of the present invention and at least one constituent component selected from a photoconductor, a charging unit, a cleaning unit, etc.

Notably, each of the reference characters in FIG. 5 denotes a component of the image forming apparatus as follows: 1: photoconductor (photoconductor drum), 2: developing unit, 3-3: residual developer, 3*a*: toner, 3*b*: magnetic carrier, 4: development sleeve, 5: magnetic roller, 6: doctor blade, 7: developer-containing case, 7*a*: pre-doctor, 8: toner hopper, 8*a*: toner supply port, 9: toner-conveying/stirring puddle, 50: charging roller, 58: cleaning device, 80: magnetic field-generating unit, D: developing region and S: developer container.

In the image forming apparatus having the process cartridge, in which a developing unit using the developer of the present invention, the photoconductor is rotated at a predetermined speed. While being rotated, the photoconductor is uniformly, positively/negatively charged at a predetermined level with the charging unit. Subsequently, the thus-charged photoconductor is imagewise exposed to light emitted from the exposing unit (e.g., slit exposure and laser beam scanning exposure), to thereby form an electrostatic latent image. The thus-formed electrostatic latent image is developed using toner with the developing unit. The thus-developed toner image is transferred with the transfer unit onto a recording medium which is fed from a paper-feed portion to between the photoconductor and the transfer unit in synchronization with rotation of the photoconductor. The recording medium having undergone image transfer is separated from the photoconductor and fed into the fixing unit for image fixing. The formed printed product is discharged from the image forming apparatus. The photoconductor surface after image transfer is cleaned with the cleaning unit for removing the residual toner, followed by charge elimination. The thus-treated photoconductor is used for the subsequent electrophotographic process.

That is, the image forming method of the present invention includes forming an electrostatic latent image on an image bearing member, developing the electrostatic latent image with the use of a developer containing at least a toner and a carrier so as to form a visible image, transferring the image onto a recording medium, and fixing the transferred image onto the recording medium. This image forming method uses the above-described electrophotographic developer of the present invention.

EXAMPLES

The present invention will next be described in more detail by was of Examples and Comparative Examples, which should not be construed as limiting the present invention thereto. Note that the unit "part(s)" is on a mass basis.

Example 1

Firstly, carriers and toners were produced under the following conditions.

[Carrier 1]

[Carrier Coat Layer]

Silicone resin solution [solid content: 23% by mass (SR2410, product of product of Dow Corning Toray Silicone Co., Ltd.)]: 432.2 parts by mass Aminosilane [solid content: 100% by mass (SH6020: product of Dow Corning Toray Silicone Co., Ltd.)]: 0.66 parts by mass Conductive microparticles EC-500 [product of Titan Kogyo]: 145 parts by mass (particle diameter: 0.43 μm, true specific gravity: 4.6, specific powder resistivity: 3) (conductivity-imparted microparticles prepared from titanium oxide (base material; specific powder resistivity: 9)) Toluene: 300 parts by mass The above-listed components were dispersed for 10 min with a homomixer to prepare a solution for forming a silicone resin coat layer. As a core material, fired ferrite powder (average particle diameter: 35 μm, true specific gravity: 5.5) was used in an amount of 5,000 parts by mass. The above-prepared solution was applied onto the surface of the core material to a thickness of 0.35 μm using a Spira coater (product of Okada Seiko Co.) with the internal temperature thereof being 40° C., followed by drying. The thus-obtained carrier was fired in an electric furnace at 200° C. for 1 hour. After cooling, the bulk of the ferrite powder was treated with a sieve having a mesh size of 63 μm, to thereby prepare [Carrier 1] having a D/h of 1.2, static resistivity of 12.9 [Log (Ω·cm)], dynamic resistivity of 6.4 [Log (Ω)], and magnetization of 68 $Am^2/kg$. The coating rate of the conductive microparticles contained in the resin coat layer was found to be 71% with respect to the core material.

The average particle diameter of the carrier core material was measured using a Microtrack particle size analyzer of SRA type (product of Nikkiso Co.) with the range being set to 0.7 μm to 125 μm (note that the average particle diameter was denoted by D50).

The thickness of the coat layer (binder resin layer) was determined as follows: the cross section of the carrier is observed with a transmission electron microscope to measure the thickness of the coat layer; and the obtained values were averaged.

The magnetization was measured with VSM-P7-15 (product of Toei Industry Co.) as follows. Specifically, a sample of about 0.15 g was weighed and charged into a cell (inner diameter: 2.4 mm, height: 8.5 mm), and was measured in an applied magnetic field of 1,000 Oersted (Oe). Note that 1,000 Oersted correspond to 1,000 ($10^3/4\pi \cdot A/m$).

[Toner]: (Toner 1)

A reaction vessel equipped with a condenser, a stirrer and a nitrogen gas-introducing tube was charged with an ethylene oxide 2-mole adduct of bisphenol A (229 parts), a propylene oxide 3-mole adduct of bisphenol A (529 parts), terephthalic acid (208 parts), adipic acid (46 parts) and dibutyltin oxide (2 parts), and the mixture was allowed to react at 230° C. for 8 hours under normal pressure. Subsequently, the resultant mixture was allowed to react for 5 hours under reduced pressure (10 mmHg to 15 mmHg). Thereafter, trimellitic anhydride (44 parts) was added to the reaction vessel, followed by reaction at 180° C. for 2 hours under normal pressure, to thereby synthesize an unmodified polyester resin.

The thus-obtained unmodified polyester resin was found to have a number average molecular weight of 2,500, weight average molecular weight of 6,700, glass transition temperature of 43° C. and acid value of 25 mgKOH/g.

Subsequently, water (1,200 parts), carbon black Printex 35 (DBP oil-absorption amount: 42 mL/100 mg, pH: 9.5, product of Deggusa Co.) (540 parts) and the above-obtained unmodified polyester resin (1,200 parts) were mixed one another with a Henschel mixer (product of Mitsui Mining Co.). Using a two-roll mill, the resultant mixture was kneaded at 150° C. for 30 min, followed by calendering and cooling. The product was pulverized with a pulverizer (product of Hosokawa Micron Co.) to prepare a masterbatch.

A reaction vessel equipped with a stirring rod and a thermometer was charged with the above-obtained unmodified polyester resin (378 parts), carnauba wax (110 parts), salicylic acid metal complex E-84 (product of Orient Chemical Industries, Ltd.) (22 parts) and ethyl acetate (947 parts), and the mixture was heated to 80° C. under stirring. The resultant mixture was maintained at 80° C. for 5 hours and then cooled to 30° C. over 1 hour. Subsequently, the above-prepared masterbatch (500 parts) and ethyl acetate (500 parts) were charged into the reaction vessel, followed by mixing for 1 hour, to thereby prepare a raw material solution.

A part (1,324 parts) of the thus-prepared raw material solution was charged into a reaction vessel, and C.I. pigment red and carnauba wax were dispersed therein with a bead mill (Ultra Visco Mill, product of Aymex Co.) under the following conditions: liquid-feeding rate: 1 kg/hr; disc circumferential speed: 6 m/sec; amount of 0.5 mm-zirconia beads charged: 80% by volume; and pass time: 3, whereby a wax dispersion was obtained.

Subsequently, a 65% by mass ethyl acetate solution of the unmodified polyester resin (1,324 parts) was added to the thus-obtained wax dispersion. The resultant mixture was dispersed with an Ultra Visco Mill under the same conditions as described above (except that the pass time was changed to 1). Thereafter, to the resultant dispersion (200 parts) was added an inorganic layered mineral-montmorillonite where at least a part thereof had been modified with a quaternary ammonium salt having a benzyl group (Clayton APA, product of Southern Clay Products, Inc.) (3 parts), followed by stirring for 30 min with a T. K. Homodisper (product of Tokushu Kika Kogyo Co.), to thereby prepare a dispersion of toner materials.

As described below, the thus-obtained dispersion was measured for its viscosity using a rheometer AR 2000 with parallel plates having a diameter of 20 mm (product of TA Instruments Japan Co.) with the gap being set to 30 μm.

Specifically, a shearing force was applied to the dispersion at 25° C. and at a shearing speed of 30,000/sec for 30 sec. In this state, the viscosity was measured (viscosity B). In addition, the shearing speed was changed from 0/sec to 70/sec over 20 sec. In this state, the viscosity was measured (viscosity A).

A reaction vessel equipped with a condenser, a stirrer and a nitrogen gas-introducing tube was charged with an ethylene oxide 2-mole adduct of bisphenol A (682 parts), a propylene oxide 2-mole adduct of bisphenol A (81 parts), terephthalic acid (283 parts), trimellitic anhydride (22 parts) and dibutyltin oxide (2 parts), and the mixture was allowed to react at 230° C. for 8 hours under normal pressure. Subsequently, the resultant mixture was allowed to react for 5 hours under reduced pressure (10 mmHg to 15 mmHg), to thereby synthesize a polyester resin intermediate.

The thus-obtained polyester resin intermediate was found to have a number average molecular weight of 2,100, weight average molecular weight of 9,500, glass transition temperature of 55° C., acid value of 0.5 mgKOH/g and hydroxyl value of 51 mgKOH/g.

A reaction vessel equipped with a condenser, a stirrer and a nitrogen gas-introducing tube was charged with the above-obtained polyester resin intermediate (410 parts), isophorone diisocyanate (89 parts) and ethyl acetate (500 parts), and the resultant mixture was allowed to react at 100° C. for 5 hours to prepare a prepolymer. The free isocyanate content of the thus-prepared prepolymer was found to 1.53% by mass.

Separately, a reaction vessel equipped with a stirring rod and a thermometer was charged with isophorone diamine (170 parts) and methyl ethyl ketone (75 parts), and the resultant mixture was allowed to react at 50° C. for 5 hours to prepare a ketimine compound. The ketimine compound was found to have an amine value of 418 mgKOH/g.

A reaction vessel was charged with the dispersion of toner materials (749 parts), the prepolymer (115 parts) and the ketimine compound (2.9 parts), and the resultant mixture was mixed with a TK homomixer (product of Tokushu Kika Kogyo Co.) at 5,000 rpm for 1 min to prepare an oil-phase liquid mixture.

A reaction vessel equipped with a stirring rod and a thermometer was charged with water (683 parts), a reactive emulsifier Eleminol RS-30 (sodium salt of sulfuric acid ester of methacrylic acid-ethylene oxide adduct, product of Sanyo Chemical Industries, Ltd.) (11 parts), styrene (83 parts), methacrylic acid (83 parts), butyl acrylate (110 parts) and ammonium persulfate (1 part), and the resultant mixture was stirred at 400 rpm for 15 min to prepare an emulsion. The thus-obtained emulsion was heated to 75° C. and allowed to react for 5 hours. Subsequently, a 1% by mass aqueous ammonium persulfate solution (30 parts) was added to the reaction mixture, followed by ripening at 75° C. for 5 hours, to thereby prepare a dispersion of resin particles.

(Particle Diameter and its Distribution of Particles Contained in Dispersion of Toner Materials)

In the present invention, particles contained in the dispersion of toner materials were measured for their particle diameter and distribution thereof using a Microtrack UPA-150, and the obtained values were analyzed using analysis software: Microtrack particle size analyzer Ver.10.1.2-016EE (these products are of Nikkiso Co.). Specifically, the dispersion of toner materials was added to a 30 mL-sample bottle made of glass. Subsequently, the solvent used for preparing this dispersion was added thereto to prepare a 10% by mass dispersion. The thus-prepared dispersion was dispersed for 2 min with an ultrasonic wave disperser (W-113MK-II, product of Honda Electric Co.).

Firstly, a background value was measured using the solvent used for preparing the dispersion of toner materials. Thereafter, the particle diameter of the particles dispersed was measured with the sample loading value of the meter being adjusted to 1 to 10. Notably, in this method, it is important that the measurement is carried out with the sample loading value of the meter being adjusted to 1 to 10, considering attaining measurement reproducibility with respect to the particle diameter of the particles dispersed. In order to assure a sample loading value falling within the above range, the amount of the dispersion dropped must be adjusted.

The measurement/analysis conditions were as follows: distribution type: volume; selection of particle diameter section: standard; channel number: 44; measuring period: 60 sec; measurement times: 1; particle permeability: permeable; refractive index of particles: 1.5; shape of particles: non-spherical; density: 1 g/cm$^3$; and refractive index of solvent: value of the solvent for preparing the dispersion of toner materials, noted in "Sokuteiji no nyuryokujoken ni kansuru gaidorain (Guideline for input conditions at measuring)" edited by Nikkiso Co.

Water (990 parts), the dispersion of resin particles (83 parts), a 48.5% by mass aqueous solution of sodium dodecyldiphenylether disulfonate (Eleminol MON-7, product of Sanyo Chemical Industries, Ltd.) (37 parts), a 1% by mass aqueous solution of polymer dispersant of sodium carboxymethyl cellulose (Cellogen BS-H-3, product of Dai-ichi Kogyo Seiyaku Co.) (135 parts) and ethyl acetate (90 parts) were mixed/stirred one another to prepare an aqueous medium.

The oil-phase liquid mixture (867 parts) was added to the thus-prepared aqueous medium (1,200 parts), the resultant mixture was mixed at 13,000 rpm for 20 min with a TK homomixer to prepare a dispersion (emulsion slurry).

Subsequently, the emulsion slurry was charged into a reaction vessel equipped with a stirrer and a thermometer, followed by solvent removal at 30° C. for 8 hours and then ripening at 45° C. for 4 hours, to thereby prepare a dispersion slurry.

The toner used in the present invention was measured for its volume average particle diameter (Dv) and number average particle diameter (Dn) using a particle size analyzer (Multisizer III, product of Beckman Coulter Co.) with an aperture diameter being set to 100 μm, and the obtained values were analyzed with analysis software (Beckman Coulter Multisizer 3 Version 3.51.).

Specifically, a 10% by mass surfactant (alkylbenzene sulfonate, Neogen SC-A, product of Daiichi Kogyo Seiyaku Co.) (0.5 mL) was added to a 100 mL-glass beaker, and a toner sample (0.5 g) was added thereto, followed by stirring with a microspartel. Subsequently, ion-exchange water (80 mL) was added to the beaker, and the obtained dispersion was dispersed with an ultrasonic wave disperser (W-113MK-II, product of Honda Electronics Co.) for 10 min. The resultant dispersion was measured using the above Multisizer III and, as a solution for measurement, Isoton III (product of Beckman Coulter Co.). The dispersion containing the toner sample was dropped so that the concentration indicated by the meter fell within a range of 8%±2%. Notably, in this method, it is important that the concentration is adjusted to 8%±2%, considering attaining measurement reproducibility with respect to the particle diameter. No measurement error is observed, so long as the concentration falls within the above range.

The above-prepared dispersion slurry (100 parts) was filtrated under reduced pressure, and ion-exchange water (100 parts) was added to a filtrated cake, followed by mixing at 12,000 rpm for 10 min with a TK homomixer.

The resultant mixture was filtrated, and 10% by mass hydrochloric acid was added to a filtrated cake so that the pH was adjusted to 2.8, followed by mixing at 12,000 rpm for 10 min with a TK homomixer and then filtration.

Subsequently, ion-exchange water (300 parts) was added to a filtrated cake, followed by mixing at 12,000 rpm for 10 min with a TK homomixer and then filtration. This procedure was repeated one more time to prepare a final filtered cake.

The thus-obtained final filtrated cake was dried at 45° C. for 48 hours using an air-circulating drier, and then was caused to pass through a sieve with a mesh size of 75 μm, to thereby prepare base toner particles.

Thereafter, hydrophobic silica (1.0 part) and hydrophobic titanium oxide (0.5 parts) were added, as an external additive, to the obtained base toner particles (100 parts), and the resultant mixture was mixed using a Henschel mixer (product of Mitsui Mining Co.) to produce a toner ([Toner 1]).

The thus-produced [Toner 1] (7 parts) and [Carrier 1] (93 parts) were mixed/stirred each other to produce a developer with a toner concentration of 7% by mass. The thus-obtained developer was evaluated for its color smear, carrier adhesion, image density and durability (change in charge amount, change in resistivity). Table 1 shows main properties of the developer (circularity of toner, volume resistivity of carrier, coating rate, D/h and magnetic moment). Table 2 shows evaluation results.

Next will be described methods/conditions for evaluation in Examples.

<Cleaning Performance>

The cleaning performance was evaluated as follows. In an initial state and after printing of 1,000 sheets or 100,000 sheets, toner remaining on the photoconductor, which had undergone a cleaning step, was transferred onto a blank paper sheet with a piece of scotch tape (product of Sumitomo 3M Ltd.). The white paper was measured for its density with a MacBeth reflective densitometer model RD514. The difference between the obtained value and the blank value was calculated, and the cleaning performance was evaluated the following criteria: difference≦0.01: good (A); and difference≦0.01: bad (B).

<Color Smear >

A value of ΔE was determined based on images formed in an initial state and after printing of 30,000 sheets. Specifically, a single-color image was printed out using a modified full-color printer, which had been produced from a commercially available digital full-color printer (imagio Neo C455, product of Ricoh Company, Ltd.) at an initial state or after being subjected to running of 30,000-sheet printing of an image chart with an image area ratio of 0.5%. The value ΔE was calculated using the below-described equation and evaluated according to the following criteria: ΔE≦2: no color smear (A); 2≦ΔE≦4: slight color smear (B)-unnoticeable change in color tone; and 4≦ΔE: considerable color smear (C)-noticeable change in color tone.

Each of the images output is measured for its image density with an X-Rite 938 (product of X-Rite Co.). At a point where the density of a yellow image is 1.4±0.5, the three values CIEL*, CIEa*, and CIEb* are measured and averaged. The value ΔE is calculated from the obtained average and the following equation:

$$\Delta E = \sqrt{((\text{Initial } L^*)^2 + (\text{Initial } a^*)^2 + (\text{Initial } b^*)^2)} - \sqrt{((\text{Run } L^*)^2 + (\text{Run } a^*)^2 + (\text{Run } b^*)^2)}$$

<Carrier Adhesion >

The developer was set in a modified full-color printer, which had been produced from a commercially available digital full-color printer (imagio Neo C455, product of Ricoh Company, Ltd.). This full-color printer was adjusted to a charge voltage of DC 740V and developing bias of 600V (background potential: 140V (constant)) and then a half-tone dot image was printed out. Thereafter, carriers adhering to the photoconductor surface were visually counted with a loupe at 5 different sites, and the obtained numbers were averaged. Further, the average was reduced to a value per 100 $cm^2$, which was regarded as the amount of carriers adhering to the edges. Notably, this amount was measured in an initial state and after running of 300,000-sheet printing. The evaluation thereof was performed the following criteria: average≦20: A; 21≦average≦60: B; 61≦average≦80: C; and 81≦average: D, wherein A, B or C was regarded as "pass" and D as "rejection."

Also, white void (in an image portion) was determined based on the number of white voids formed on a solid image (A3 size). This image was formed using the above modified full-color printer in which a charge voltage had been adjusted to DC 740V and a developing bias 600V (background potential: 140V (constant)). Notably, the white void (in the image portion) was determined in an initial state and after running of 300,000-sheet printing. The evaluation thereof was performed the following criteria: white voids≦5: A; 6≦white voids≦10: B; 11≦white voids≦20: C; and 21≦white voids: D, wherein A, B or C was regarded as "pass" and D as "rejection."

<Image Density >

A solid image was printed out on 6000 paper (product of Ricoh Company Ltd.) using the modified full-color printer after being subjected to running of 300,000-sheet printing of an image chart with an image area ratio of 50% in a monochrome mode. The obtained image was measured for its image density with an X-Rite (product of X-Rite Co.). The measurement was evaluated according to the following criteria: 1.8≦A≦2.2; 1.4≦B≦1.8; 1.2≦C≦1.4; and D≦1.2. The evaluation results are shown in Table 2. Note that the image density was measured also in an initial state.

<Durability >

Firstly, the developer was set in a modified full-color printer, which had been produced from a commercially available digital full-color printer (imagio Neo C455, product of Ricoh Company, Ltd.). This full-color printer was subjected to running of 300,000-sheet printing of an image chart with an image area ratio of 50% in a monochrome mode and then a change in charge amount of the carrier was evaluated. Separately, in a manner similar to that performed for evaluating a change in charge amount, except that the image area ratio was changed to 0.5%, to thereby evaluate a change in resistivity of the carrier.

As used herein, the "change in charge amount" is a value determined as follows. Specifically, a carrier and a toner are maintained in a normal temperature, normal humidity chamber (temperature: 23.5° C., humidity: 60% RH) for humidity conditioning in an unsealed system for 30 min or longer. Subsequently, this initial carrier (6.000 g) and the toner (0.452 g) are placed in a stainless steel container, followed by sealing. The stainless steel container is shaken about 1,100 times for 5 min using the YS-LD shaker (product of Yayoi Co.) with the graduation being set to 150, to thereby produce a frictionally-charged sample. The thus-prepared sample is measured for its charge amount (Q1) with a commonly used blow-off method using TB-200 (product of Kyocera Chemical Co.). Separately, after running, the toner is removed from the developer using the above blow-off device, and the thus-obtained carrier is measured for its charge amount (Q2) in the same manner as described above. The thus-obtained Q2 is subtracted from the Q1. Preferably, the value (Q1-Q2) falls within a range of ±10.0 (μc/g).

As used herein, the "change in resistivity" is a value determined as follows. Specifically, the above-treated initial carrier is measured for its resistivity (R1) with the measuring method as described above. Separately, after running, the toner is removed from the developer using the above blow-off device, and the thus-obtained carrier is similarly measured for its resistivity (R2). The thus-obtained R2 is subtracted from the R1. Preferably, the value (R1-R2) falls within a range of ±3.0 [Log (QΩcm)]. This change in resistivity is caused as a result of, for example, delamination of the binder resin coating the carrier, toner spent and exfoliation of particles from the carrier coat layer. Thus, prevention of the occurrence of these can make the change in resistivity small.

Example 2

The procedure of Example 1 was repeated, except that an acrylic resin solution was used in the composition for a coat layer, to thereby prepare [Carrier 2] having a D/h of 1.1, static resistivity of 13.1 [Log (Ω·cm)], dynamic resistivity of 7.3 [Log (Ω)] and magnetization of 68 $Am^2/kg$. The coating rate of the conductive microparticles contained in the resin coat layer was found to be 71% with respect to the core material.

Acrylic resin solution (solid content: 50% by mass): 34.2 parts by mass Guanamine solution (solid content: 70% by mass): 9.7 parts by mass Acidic catalyst (solid content: 40% by mass): 0.19 parts by mass Silicone resin solution [solid content: 20% by mass (SR2410: product of Dow Corning Toray Silicone Co., Ltd.)]: 432.2 parts by mass Aminosilane [solid content: 100% by mass (SH6020: product of Dow Corning Toray Silicone Co., Ltd.)]:3.42 parts by mass Conductive microparticles EC-500 [product of Titan Kogyo]:145 parts by mass Similar to Example 1, the thus-prepared [Carrier 2] was mixed with [Toner 1] to prepare a developer and then the developer was evaluated. The results are shown in Table 2.

Example 3

The procedure of Example 2 was repeated, except that the amounts of acrylic resin and silicone resin were changed in the composition for a coat layer, to thereby prepare [Carrier 3] having a D/h of 1.9, static resistivity of 13.1 [Log (Ω·cm)], dynamic resistivity of 6.9 [Log (Ω)] and magnetization of 68 $Am^2/kg$. The coating rate of the conductive microparticles contained in the resin coat layer was found to be 71% with respect to the core material.

Acrylic resin solution (solid content: 50% by mass): 17.1 parts by mass Guanamine solution (solid content: 70% by mass): 4.85 parts by mass Acidic catalyst (solid content: 40% by mass): 0.10 parts by mass Silicone resin solution [solid content: 20% by mass (SR2410: product of Dow Corning Toray Silicone Co., Ltd.)]: 216.2 parts by mass Aminosilane [solid content: 100% by mass (SH6020: product of Dow Corning Toray Silicone Co., Ltd.)]: 1.68 parts by mass Conductive microparticles EC-500 [product of Titan Kogyo]: 145 parts by mass Toluene: 1,600 parts by mass Similar to Example 1, the thus-prepared [Carrier 3] was mixed with [Toner 1] to prepare a developer and then the developer was evaluated. The results are shown in Table 2.

Example 4

The procedure of Example 2 was repeated, except that the ratio of acrylic resin to silicone resin was changed in the composition for a coat layer, to thereby prepare [Carrier 4] having a D/h of 0.4, static resistivity of 16.5 [Log (Ω·cm)], dynamic resistivity of 8.5 [Log (Ω)] and magnetization of 68 $Am^2/kg$. The coating rate of the conductive microparticles contained in the resin coat layer was found to be 71% with respect to the core material.

Acrylic resin solution (solid content: 50% by mass): 158.8 parts by Mass

Guanamine solution (solid content: 70% by mass): 49.6 parts by mass Acidic catalyst (solid content: 40% by mass): 0.88 parts by mass Silicone resin solution [solid content: 20% by mass (SR2410: product of Dow Corning Toray Silicone Co., Ltd.)]: 743.2 parts by mass Aminosilane [solid content: 100% by mass (SH6020: product of Dow Corning Toray Silicone Co., Ltd.)]: 1.68 parts by mass Conductive microparticles EC-500 [product of Titan Kogyo]: 145 parts by mass Toluene: 1,600 parts by mass Similar to Example 1, the thus-prepared [Carrier 4] was mixed with [Toner 1] to prepare a developer and then the developer was evaluated. The results are shown in Table 2.

Example 5

The procedure of Example 1 was repeated, except that the amount of the conductive microparticles EC-500 was reduced from 145 parts by mass to 75 parts by mass, to thereby prepare [Carrier 5] having a D/h of 1.2, static resistivity of 15.3 [Log (Ω·cm)], dynamic resistivity of 7.5 [Log (Ω)] and magnetization of 68 $Am^2/kg$. The coating rate of the conductive microparticles contained in the resin coat layer was found to be 41% with respect to the core material. Similar to Example 1, the thus-prepared [Carrier 5] was mixed with [Toner 1] to prepare a developer and then the developer was evaluated. The results are shown in Table 2.

Example 6

The procedure of Example 1 was repeated, except that a carrier core material having a weight average particle diameter of 18 μm (true specific gravity: 5.7) was used, and that the composition for a coat layer was changed to that listed below, to thereby prepare [Carrier 6] having a D/h of 1.1, static resistivity of 13.7 [Log (Ω·cm)], dynamic resistivity of 7.6 [Log (Ω)] and magnetization of 66 $Am^2/kg$. Acrylic resin solution (solid content: 50% by mass): 68.4 parts by mass Guanamine solution (solid content: 70% by mass): 19.4 parts by mass Acidic catalyst (solid content: 40% by mass): 0.38 parts by mass Silicone resin solution [solid content: 20% by mass (SR2410: product of Dow Corning Toray Silicone Co., Ltd.)]: 864.4 parts by mass Aminosilane [solid content: 100% by mass (SH6020: product of Dow Corning Toray Silicone Co., Ltd.)]: 0.46 parts by mass Conductive microparticles EC-500 [product of Titan Kogyo]: 275 parts by mass Toluene: 800 parts by mass Similar to Example 1, the thus-prepared [Carrier 6] was mixed with [Toner 1] to prepare a developer and then the developer was evaluated. The results are shown in Table 2. The coating rate of the conductive microparticles contained in the resin coat layer was found to be 71% with respect to the core material.

Example 7

The procedure of Example 1 was repeated, except that a carrier core material having a weight average particle diameter of 71 μm (true specific gravity: 5.3) was used, and that the composition for a coat layer was changed to that listed below, to thereby prepare [Carrier 7] having a D/h of 0.7, static resistivity of 12.5 [Log (Ω·cm)], dynamic resistivity of 7.2 [Log (Ω)] and magnetization of 69 $Am^2/kg$. Acrylic resin solution (solid content: 50% by mass): 34.2 parts by mass Guanamine solution (solid content: 70% by mass): 9.7 parts by mass Acidic catalyst (solid content: 40% by mass): 0.19 parts by mass Silicone resin solution [solid content: 20% by mass (SR2410: product of Dow Corning Toray Silicone Co., Ltd.)]: 292.9 parts by mass Aminosilane [solid content: 100% by mass (SH6020: product of Dow Corning Toray Silicone Co., Ltd.)]: 0.42 parts by mass Conductive microparticles EC-500 [product of Titan Kogyo]: 85 parts by mass Toluene: 800 parts by mass Similar to Example 1, the thus-prepared [Carrier 7] was mixed with [Toner 1] to prepare a developer and then the developer was evaluated. The results are shown in Table 2. The coating rate of the conductive microparticles contained in the resin coat layer was found to be 81% with respect to the core material.

Example 8

The procedure of Example 2 was repeated, except that 36 μm-fired ferrite (true specific gravity: 5.4) having low magnetization was used, to thereby prepare [Carrier 8] having a D/h of 1.1, static resistivity of 13.9 [Log (Ω·cm)], dynamic resistivity of 6.8 [Log (Ω)] and magnetization of 35 $Am^2/kg$.

Similar to Example 1, the thus-prepared [Carrier 8] was mixed with [Toner 1] to prepare a developer and then the developer was evaluated. The results are shown in Table 2. The coating rate of the conductive microparticles contained in the resin coat layer was found to be 71% with respect to the core material.

Example 9

The procedure of Example 2 was repeated, except that 35 μm-fired ferrite (true specific gravity: 5.5) having high magnetization was used, to thereby prepare [Carrier 9] having a D/h of 1.1, static resistivity of 14.1 [Log (Ω·cm)], dynamic resistivity of 8.2 [Log (Ω)] and magnetization of 93 $Am^2/kg$. Similar to Example 1, the thus-prepared [Carrier 9] was mixed with [Toner 1] to prepare a developer and then the developer was evaluated. The results are shown in Table 2. The coating rate of the conductive microparticles contained in the resin coat layer was found to be 71% with respect to the core material.

Example 10

The procedure of Example 1 was repeated, except that the conductive microparticles were changed from conductive microparticles EC-500 to conductive microparticles EC-700.

[Carrier Coat Layer]

Silicone resin solution [solid content: 23% by mass (SR2410: product of Dow Corning Toray Silicone Co., Ltd.)]: 432.2 parts by mass Aminosilane [solid content: 100% by mass (SH6020: product of Dow Corning Toray Silicone Co., Ltd.)]: 0.66 parts by mass Conductive microparticles EC-700 [product of Titan Kogyo]: 145 parts by mass (particle diameter: 0.41 μm, true specific gravity: 4.3, specific powder resistivity: 4) (conductivity-imparted microp articles prepared from alumina (base material; specific powder resistivity: 12)) Toluene: 300 parts by mass The above-listed components were dispersed for 10 min with a homomixer to prepare a solution for forming a silicone resin coat layer. As a core material, fired ferrite powder (average particle diameter: 35 μm, true specific gravity: 5.5) was used in an amount of 5,000 parts by mass. The above-prepared solution was applied onto the surface of the core material to a thickness of 0.35 μm using a Spira coater (product of Okada Seiko Co.) with the internal temperature thereof being 40° C., followed by drying. The thus-obtained carrier was fired in an electric furnace at 200° C. for 1 hour. After cooling, the bulk of the ferrite powder was treated with a sieve having a mesh size of 63 μm, to thereby prepare [Carrier 10] having a D/h of 0.9, static resistivity of 12.9 [Log (Ω·cm)], dynamic resistivity of 7.8 [Log (Ω)] and magnetization of 68 $Am^2/kg$. The coating rate of the conductive microparticles contained in the resin coat layer was found to be 79% with respect to the core material. Similar to Example 1, the thus-prepared [Carrier 10] was mixed with [Toner 1] to prepare a developer and then the developer was evaluated. The results are shown in Table 2.

Comparative Example 1

The below-listed components were dispersed with a homomixer for 10 min to prepare a silicone resin solution for forming a carrier coat layer.

[Composition of Carrier Coat Layer-Forming Solution]

Silicone resin solution [solid content: 23% by mass (SR2410: product of Dow Corning Toray Silicone Co., Ltd.)]: 432.2 parts by mass Aminosilane [solid content: 100% by mass (SH6020: product of Dow Corning Toray Silicone Co., Ltd.)]: 0.66 parts by mass Carbon black MA100R (product of Mitsubishi Chemical Industries Ltd.): 20 parts by mass Toluene: 300 parts by mass As a carrier core material, fired ferrite powder (average particle diameter: 35 μm, true specific gravity: 5.5) was used in an amount of 5,000 parts by mass. The above-prepared solution was applied onto the surface of the core material to a thickness of 0.35 μm using a Spira coater (product of Okada Seiko Co.) with the internal temperature thereof being 40° C., followed by drying. The thus-obtained carrier was fired in an electric furnace at 200° C. for 1 hour. After cooling, the bulk of the ferrite powder was treated with a sieve having a mesh size of 63 μm, to thereby prepare [Carrier 11] having a static resistivity of 12.9 [Log (Ω·cm)], dynamic resistivity of 7.9 [Log (Ω)] and magnetization of 68 $Am^2/kg$.

Similar to Example 1, the thus-prepared [Carrier 11] was mixed with [Toner 1] to prepare a developer and then the developer was evaluated. The main properties (circularity of toner, volume resistivity of carrier, coating rate, D/h and magnetic moment) are shown in Table 1, and the evaluation results are shown in Table 2

Comparative Example 2

The procedure of Example 1 was repeated, except that Clayton APA (product of Southern Clay Products, Inc.) (3 parts) used for forming the toner was changed to MEK-ST-UP (product of NISSAN CHEMICAL INDUSTRIES, LTD.) (45 parts), to thereby prepare [Toner 2].

Similar to Example 1, the thus-prepared [Toner 2] was mixed with [Carrier 1] to prepare a developer and then the developer was evaluated. The main properties (circularity of toner, volume resistivity of carrier, coating rate, D/h and magnetic moment) are shown in Table 1, and the evaluation results are shown in Table 2.

Comparative Example 3

The procedure of Example 1 was repeated, except that the composition for a coat layer was changed to that listed below, to thereby prepare [Carrier 12] having a D/h of 0.9, static resistivity of 16.1 [Log (Ω·cm)], dynamic resistivity of 9.7 [Log (Ω)] and magnetization of 68 $Am^2/kg$. The coating rate of the oxidized inorganic particles contained in the resin coat layer was found to be 83% with respect to the core material. Acrylic resin solution (solid content: 50% by mass): 34.2 parts by mass Guanamine solution (solid content: 70% by mass): 9.7 parts by mass Acidic catalyst (solid content: 40% by mass): 0.19 parts by mass Silicone resin solution [solid content: 20% by mass (SR2410: product of Dow Corning Toray Silicone Co., Ltd.)]: 432.2 parts by mass Aminosilane [solid content: 100% by mass (SH6020: product of Dow Corning Toray Silicone Co., Ltd.)]: 3.42 parts by mass Oxidized inorganic microparticles B (aluminum oxide, particle diameter: 0.37 μm, true specific gravity 3.9): 97 parts by mass Similar to Example 1, the thus-prepared [Carrier 12] was mixed with [Toner 1] to prepare a developer and then the developer was evaluated. The main properties (circularity of toner, volume resistivity of carrier, coating rate, D/h and magnetic moment) are shown in Table 1, and the evaluation results are shown in Table 2.

Comparative Example 4

The procedure of Comparative Example 1 was repeated, except that the amount of carbon black was increased from 20 parts by mass to 60 parts by mass, to thereby prepare [Carrier 13] having a static resistivity of 8.9 [Log (Ω·cm)], dynamic resistivity of 6.1 [Log (Ω)] and magnetization of 68 $Am^2/kg$.

Similar to Example 1, the thus-prepared [Carrier 13] was mixed with [Toner 1] to prepare a developer and then the developer was evaluated. The main properties (circularity of toner, volume resistivity of carrier, coating rate, D/h and magnetic moment) are shown in Table 1, and the evaluation results are shown in Table 2.

Comparative Example 5

The below-listed components were dispersed with a homomixer for 10 min to prepare a silicone resin solution for forming a coat layer.

[Composition of Carrier Coat Layer-Forming Solution]

Silicone resin solution [solid content: 23% by mass (SR2410: product of Dow Corning Toray Silicone Co., Ltd.)]: 432.2 parts by mass Aminosilane [solid content: 100% by mass (SH6020: product of Dow Corning Toray Silicone Co., Ltd.)]: 0.66 parts by mass Titanium oxide MT150 (product of TAYCA Corporation): 220 parts by mass Toluene: 300 parts by mass As a carrier core material, fired ferrite powder (average particle diameter: 35 μm, true specific gravity: 5.5) was used in an amount of 5,000 parts by mass. The above-prepared solution was applied onto the surface of the core material to a thickness of 0.35 μm using a Spira coater (product of Okada Seiko Co.) with the internal temperature thereof being 40° C., followed by drying. The thus-obtained carrier was fired in an electric furnace at 200° C. for 1 hour. After cooling, the bulk of the ferrite powder was treated with a sieve having a mesh size of 63 μm, to thereby prepare [Carrier 14] having a static resistivity of 14.1 [Log (Ω·cm)], dynamic resistivity of 8.9 [Log (Ω)] and magnetization of 68 $Am^2/kg$.

Similar to Example 1, the thus-prepared [Carrier 14] was mixed with [Toner 1] to prepare a developer and then the developer was evaluated. The main properties (circularity of toner, volume resistivity of carrier, coating rate, D/h and magnetic moment) are shown in Table 1, and the evaluation results are shown in Table 2.

(Evaluation Method/Result for Toner)

As described below, each of the above-obtained toners was measured for its volume average particle diameter (Dv), number average particle diameter (Dn), particle size distribution (Dv/Dn), average circularity, shape factor (SF1) and cleaning performance.

The Dv and Dn were measured with the particle size analyzer Multisizer III (product of Beckman Coulter Co.) at an aperture diameter of 100 μm, and the obtained values was used to calculate the Dv/Dn.

In the present invention, (super-fine) toner particles were measured with the flow-type particle image analyzer FPIA-2100 (product of Sysmex Co.) and then the measurements were analyzed the analysis software FPIA-2100 Data Processing Program for FPIA version 00-10. Specifically, a 10% by mass surfactant (alkylbenzene sulfonate, Neogen SC-A, product of Daiichi Kogyo Seiyaku Co.) (0.1 mL to 0.5 mL) was added to a 100 mL-glass beaker, and a toner sample (0.1 g to 0.5 g) was added thereto, followed by stirring with a microspartel. Subsequently, ion-exchange water (80 mL) was added to the beaker, and the obtained dispersion was dispersed with an ultrasonic wave disperser (product of Honda Electronics Co.) for 3 min. The resultant dispersion was measured with respect to the shape/distribution of toner using the FPIA-2100 until the toner density falls within a range of 5,000/μL to 15,000/μL. Notably, in this method, it is important that the toner density of the dispersion is adjusted to 5,000/μL to 15,000/μL, considering attaining measurement reproducibility with respect to the average circularity.

In order for the toner density to fall within the above range, the conditions under which the dispersion is prepared must be modified; i.e., the amounts of a surfactant and toner added must be adjusted. The amount of the surfactant required varies depending on the hydrophobicity of the toner. Specifically, when it is added in a large amount, bubbles generated causes a noise; whereas when it is added in a small amount, the toner surface cannot be provided with sufficient wettability and thus a sufficient dispersion state cannot be attained. Meanwhile, the amount of the toner added varies depending on the particle diameter thereof. Specifically, the toner with a small particle diameter must be added in a small amount, and the toner with a large particle diameter must be added in a large amount. For example, when the toner with a particle diameter of 3 μm to 7 μm is added in an amount of 0.1 g to 0.5 g, the toner density of the formed dispersion can be adjusted to 5,000/μL to 15,000/μL.

The SF-1 was measured as follows. After vapor depositing, 100 or more toner particles were observed with the super-high resolution FE-SEM S-5200 (product Hitachi Co.) at an accelerating voltage of 2.5 keV. Subsequently, the obtained images each were analyzed for their SF1 with an image processing device and image processing software of the Luzex AP image analyzer (product of Nireco Co.).

TABLE 1

| | Carrier | Toner | Circularity of toner | Static resistivity of carrier (log Ω · cm) | Dynamic resistivity of carrier (log Ω) | Coating rate (%) | D/h (—) | Magnetic moment ($Am^2/kg$) |
|---|---|---|---|---|---|---|---|---|
| Ex. 1 | Carrier 1 | Toner 1 | 0.955 | 12.9 | 6.4 | 71 | 1.2 | 68 |
| Ex. 2 | Carrier 2 | Toner 1 | 0.955 | 13.1 | 7.3 | 71 | 1.1 | 68 |
| Ex. 3 | Carrier 3 | Toner 1 | 0.955 | 13.1 | 6.9 | 71 | 1.9 | 68 |
| Ex. 4 | Carrier 4 | Toner 1 | 0.955 | 16.5 | 8.5 | 71 | 0.4 | 68 |
| Ex. 5 | Carrier 5 | Toner 1 | 0.955 | 15.3 | 7.5 | 41 | 1.2 | 68 |
| Ex. 6 | Carrier 6 | Toner 1 | 0.955 | 13.7 | 7.6 | 71 | 1.1 | 66 |
| Ex. 7 | Carrier 7 | Toner 1 | 0.955 | 12.5 | 7.2 | 81 | 0.7 | 69 |
| Ex. 8 | Carrier 8 | Toner 1 | 0.955 | 13.9 | 6.8 | 71 | 1.1 | 35 |
| Ex. 9 | Carrier 9 | Toner 1 | 0.955 | 14.1 | 8.2 | 71 | 1.1 | 93 |
| Ex. 10 | Carrier 10 | Toner 1 | 0.955 | 12.9 | 7.8 | 79 | 0.9 | 68 |

TABLE 1-continued

| | Carrier | Toner | Circularity of toner | Static resistivity of carrier (log Ω · cm) | Dynamic resistivity of carrier (log Ω) | Coating rate (%) | D/h (—) | Magnetic moment ($Am^2/kg$) |
|---|---|---|---|---|---|---|---|---|
| Comp. Ex. 1 | Carrier 11 | Toner 1 | 0.955 | 12.9 | 7.9 | — | — | 68 |
| Comp. Ex. 2 | Carrier 1 | Toner 2 | 0.975 | 12.9 | 6.4 | 71 | 1.2 | 68 |
| Comp. Ex. 3 | Carrier 12 | Toner 1 | 0.955 | 16.1 | 9.7 | 83 | 0.9 | 68 |
| Comp. Ex. 4 | Carrier 13 | Toner 1 | 0.955 | 8.9 | 6.1 | — | — | 68 |
| Comp. Ex. 5 | Carrier 14 | Toner 1 | 0.955 | 14.1 | 8.9 | — | — | 68 |

TABLE 2

| | Evaluation in initial state | | | Cleaning | Color | Durability (25° C., 50% RH) after 300,000 printing | | | | |
|---|---|---|---|---|---|---|---|---|---|---|
| | | Carrier adhesion | | performance | smear | | | Carrier adhesion | | |
| | Image density | Edge portion | White void (image portion) | after 100,000 printing | after 30,000 printing | Change in charge amount (μc/g) | Change in resistivity (log Ω · cm) | Edge portion | White void (image portion) | Image density |
| Ex. 1 | A | A | A | A | A | +2 | 1.5 | A | A | A |
| Ex. 2 | A | A | A | A | A | 0 | 1.2 | A | A | A |
| Ex. 3 | A | A | A | A | A | −2 | 3.8 | A | B | A |
| Ex. 4 | A | C | A | A | A | −6 | 1.1 | A | A | A |
| Ex. 5 | A | A | A | A | A | +4 | 1.2 | B | A | A |
| Ex. 6 | A | A | A | A | A | +2 | 1.2 | A | A | A |
| Ex. 7 | A | A | A | A | A | −2 | 3.6 | A | B | A |
| Ex. 8 | A | A | A | A | A | +4 | 1.3 | B | A | A |
| Ex. 9 | A | A | A | A | A | −4 | 2.8 | A | A | B |
| Ex. 10 | A | A | A | A | A | −4 | 3.4 | A | B | A |
| Comp. Ex. 1 | A | A | A | A | C | — | — | — | — | — |
| Comp. Ex. 2 | A | A | A | B | — | — | — | — | — | — |
| Comp. Ex. 3 | D | C | A | A | A | 0 | 1.5 | C | B | D |
| Comp. Ex. 4 | B | A | D | A | C | — | — | — | — | — |
| Comp. Ex. 5 | A | A | A | A | A | — | — | — | — | — |

[Evaluation Results]

As is clear from Table 2, each of the developers prepared in Examples 1 to 10 (i.e., the developer of the present invention) was found to cause no color smear and to exhibit excellent results with respect to image density, carrier adhesion, reduction of changeability and reduction of resistivity. Also, the toner contained in the developer of Examples was found to exhibit excellent cleaning performance for a long period of time from the beginning.

Each of the developers of Comparative Examples 1 and 4 was found to cause color smear and not to be applicable to practical use. Also, the developer of Comparative Example 4 was found to cause, during development, a discharge between the development sleeve and the photoconductor, forming a slightly abnormal image.

The toner used in the developer of Comparative Example 2 was found to exhibit poor cleaning performance even in an initial state and thus, the same evaluation as performed in relation to the other toners could not be carried out.

The developer of Comparative Example 3 was entrained on the development sleeve, and the density of the formed image decreased in the rotating direction of the development sleeve.

The developer of Comparative Example 5 was found to cause, during development, a discharge between the development sleeve and the photoconductor after printing of 100,000 sheets, forming a slightly abnormal image (note that this developer caused no problem in an initial state). Thus, this evaluation was terminated. This discharge was caused by decrease in resistivity of the carrier, and at this time, the static resistivity thereof was found to be 8.9 [Log (Ω·cm)].

As described above, the image forming technique using the developer of Examples can consistently provide a high-quality image over a long period of time.

While Examples are given above for specifically describing the present invention, it should not be understood that the present invention is limited thereto. Various modification and alteration can be made without departing from the spirit or scope of the present invention.

What is claimed is:

1. An electrophotographic developer carrier comprising:

a carrier core material, and a coat layer comprising a binder resin and electrical conductivity-imparted microparticles which are produced by treating inorganic microparticles to be electrically conductive, the coat layer being formed over the carrier core material, wherein the inorganic microparticles before treated to be electrically conductive have a specific powder resistivity of 9 or more, and the inorganic microparticles treated to be electrically conductive have a specific powder resistivity of 7 or less, wherein the electrophotographic developer carrier has a static resistivity of 10 [Log (Ω·cm)] or higher and a dynamic resistivity of 9[Log (Ω)] or lower, and is used in an electrophotographic developer together with a negatively chargeable toner having an average circularity of 0.925 to 0.970, and wherein the toner comprises a resin, a colorant and an inorganic layered mineral in which at least part of interlayer ions is modified with organic ions, and is granulated by dispersing and/or emulsifying an oil phase and/or a monomer phase comprising at least a toner composition and/or a toner composition precursor in an aqueous medium.

2. The electrophotographic developer carrier according to claim 1, wherein a coating rate determined by an equation given below is equal to or higher than 50% and a ratio of the particle diameter of the electrical conductivity-imparted microparticles (Df) to the thickness of the coat layer (h) satisfies the relation $0.5<[Df/h]<1.5$, $$\text{Coating rate} = (Ds \times \rho s \times W)/(4 \times Df \times \rho f) \times 100$$

where Ds denotes a particle diameter of the carrier core material, ρs denotes a true specific gravity of the carrier core material, W denotes a ratio of the amount of the electrical conductivity-imparted microparticles to the amount of the carrier core material, Df denotes a particle diameter of the electrical conductivity-imparted microparticles, and ρf denotes a true specific gravity of the electrical conductivity-imparted microparticles.

3. The electrophotographic developer carrier according to claim 1, having a volume average particle diameter of 20 μm to 65 μm.

4. The electrophotographic developer carrier according to claim 1, wherein the binder resin comprises at least a silicone resin.

5. The electrophotographic developer carrier according to claim 1, wherein the binder resin is a mixture of an acrylic resin and a silicone resin.

6. The electrophotographic developer carrier according to claim 1, having a magnetic moment of 40 ($Am^2/kg$) to 90 ($Am^2/kg$) in an applied magnetic field of 1,000 ($10^3/4\pi \cdot A/m$).

7. The electrophotographic developer carrier according to claim 1, wherein the electrical conductivity-imparted microparticles are formed by a process comprising surface-treating inorganic microparticles.

8. The electrophotographic developer carrier according to claim 1, wherein the inorganic layered mineral is a smectite group mineral, a kaoline group mineral, magadiite or kanemite.

9. The electrophotographic developer carrier according to claim 1, wherein the inorganic layered mineral is modified with an organic cation.

10. The electrophotographic developer carrier according to claim 1, wherein the electrophotographic developer carrier has a static resistivity of from 10[Log (Ω·cm)] to 16[Log (Ω·cm)].

11. The electrophotographic developer carrier according to claim 1, wherein the electrophotographic developer carrier has a dynamic resistivity of from 6[Log (Ω·cm)] to 9[Log (Ω·cm)].

12. The electrophotographic developer carrier according to claim 1, wherein the carrier core material is selected from the group consisting of ferrite, Cu—Zn ferrite, Mn ferrite, Mn—Mg ferrite, Mn—Mg—Sr ferrite, magnetite, iron and nickel.

* * * * *